US010287130B2

(12) United States Patent
Morgan et al.

(10) Patent No.: US 10,287,130 B2
(45) Date of Patent: May 14, 2019

(54) LEVEL WINDER

(71) Applicant: Reel-Tech Pty Ltd, Mentone (AU)

(72) Inventors: Sean Morgan, Carlton (AU); Stuart Morgan, Carlton (AU)

(73) Assignee: REEL-TECH PTY LTD, Mentone, Victoria (AU)

( * ) Notice: Subject to any disclaimer, the term of this patent is extended or adjusted under 35 U.S.C. 154(b) by 613 days.

(21) Appl. No.: 14/434,992

(22) PCT Filed: Oct. 11, 2013

(86) PCT No.: PCT/AU2013/001168
§ 371 (c)(1),
(2) Date: Apr. 10, 2015

(87) PCT Pub. No.: WO2014/056033
PCT Pub. Date: Apr. 17, 2014

(65) Prior Publication Data

US 2015/0266699 A1 Sep. 24, 2015

(30) Foreign Application Priority Data

Oct. 11, 2012 (AU) ..... 2012904447

(51) Int. Cl.
*B65H 63/04* (2006.01)
*B65H 75/44* (2006.01)

(52) U.S. Cl.
CPC ..... *B65H 75/4407* (2013.01); *B65H 63/04* (2013.01); *B65H 75/4442* (2013.01); *B65H 2701/33* (2013.01)

(58) Field of Classification Search
CPC ..... B65H 75/4407; B65H 75/4442; B65H 2701/33; B65H 57/28; B65H 63/04; B65H 54/2821; Y10T 137/6932
(Continued)

(56) References Cited

U.S. PATENT DOCUMENTS 1,409,328 A 3/1922 Wewolfe
3,064,912 A 11/1962 Bittman
(Continued)

FOREIGN PATENT DOCUMENTS

DE 10128337 A1 1/2003
DE 102011008517 A1 7/2012
(Continued)

*Primary Examiner* — William E Dondero
(74) *Attorney, Agent, or Firm* — William J. Clemens; Shumaker, Loop & Kendrick, LLP

(57) ABSTRACT

A level winder (10, 110, 210, 310) for use on a hose reel (1), the level winder including: a carriage (20, 120, 220) operatively connected to a hose guide (104-108), the carriage adapted to control the winding of the hose onto the hose reel and to allow the hose to be paid out through the hose guide; and a drive mechanism 30 carrying at least one drive dog (32, 136) that is adapted to travel in a substantially vertical drive mechanism plane and to engage a carriage guide (12, 112) on which the carriage is mounted to move the carriage reciprocally along a track. The carriage guide is aligned in the same plane that the drive dog travels and the carriage guide comprises at least one curved surface (14, 114) adapted to define a recess (13, 113) and to engage a curved surface of the drive dog (16, 116), such that at least a portion of the drive dog curved surface (I6) is always facing or engaged with the carriage guide curved surface (14) and remains trapped in the recess (12, 113).

11 Claims, 18 Drawing Sheets

(58) Field of Classification Search
USPC ..... 137/355.2
See application file for complete search history.

(56) References Cited

U.S. PATENT DOCUMENTS

| | | | | |
|---|---|---|---|---|
| 3,315,914 | A | 4/1967 | Turner | |
| 3,397,850 | A * | 8/1968 | Anderson | B65H 54/2821 242/447.1 |
| 3,602,447 | A | 8/1971 | Fisher et al. | |
| 3,716,200 | A * | 2/1973 | Sartori | B65H 54/2821 242/481.4 |
| 4,085,621 | A | 4/1978 | Hadaway | |
| 4,251,036 | A | 2/1981 | McLain | |
| 4,352,413 | A | 10/1982 | Weishew | |
| 4,586,677 | A | 5/1986 | Nevarez | |
| 4,973,007 | A | 11/1990 | Schippers et al. | |
| 5,330,122 | A | 7/1994 | Wood | |
| 7,419,137 | B2 * | 9/2008 | Boon | B65H 75/425 242/397.3 |

FOREIGN PATENT DOCUMENTS

| | | | |
|---|---|---|---|
| FR | 2072424 | A5 | 9/1971 |
| GB | 623215 | A | 5/1949 |
| GB | 891125 | A | 3/1962 |
| GB | 915275 | A | 1/1963 |
| WO | 2012135890 | A1 | 10/2012 |

* cited by examiner

Diagram 1

LEVEL WINDER

This invention relates to a level winder. In particular, the invention relates to a level winder for a reel for storing hose and cable.

BACKGROUND TO THE INVENTION

The following references to and descriptions of prior proposals or products are not intended (to be, and are not to be construed as, statements or admissions of common general knowledge in the art. In particular, the following prior art discussion does not relate to what is commonly or well known by the person skilled in the art, but assists in the understanding of the inventive step of the present invention of which the identification of pertinent prior art proposals is but one part.

Level winders devices currently available are generally complex mechanical devices (almost exclusively utilising a double acting lead screw and carriage arrangement).

The level wind of hose or cable upon a horizontal spool is typically facilitated via a reciprocating carriage sliding from the left to right side upon a horizontal guide rail, whose length of travel is dictated by the width of the spool or the structural limits of the reel frame itself. The rail system of the level wind is typically an integral part of a special and costly reel frame structure, and is not self contained as a separable modular device. Upon this carriage is usually mounted a pair of closely located vertical rollers and a pair of closely located horizontal rollers which surround the hose at a fixed pitch typically matched to the hose diameter.

These rollers move with the reciprocating carriage and act directly upon the hose to provide lateral directional guides of low frictional resistance towards the moving hose being wrapped or unwrapped from the spool, by means of their ability to act as rollers. This reciprocating action is typically facilitated via a double acting lead screw mounted horizontally either above or below a fixed carriage rail, forming a parallel carriage rail pair, and driven in one direction by the motive force acting to rotate the spool either via a manual crank device, or by some motor power means.

Hose and cable storage reels are generally not designed to carry a load bearing cable to move objects. Storage reels must allow payout without supporting a load and in most instances are required to facilitate "free" manual payout by hand without geared resistance. The hose reel need only be able to rewind the hose or cable to be stored and is not designed to apply a pull force to any other mass.

In the Applicant's International application No. PCT/AU2011/001152 published Oct. 11, 2012 as WO2012/135890, a level winder is described that is employed using a chain-mounted dog to engage and reciprocally move a carriage carrying guide rollers. The entire contents of Application No. PCT/AU2011/001152 (WO2012/135890) are incorporated herein by reference. Applicants consider that an improvement is needed to control the dwell time of the carriage at the extremes of its travel to allow improved hose or cable placement on the reel.

OBJECTS

It is an object of the invention to ameliorate one or more of the disadvantages of the prior art described above or to at least provide a useful alternative thereto.

OUTLINE OF THE INVENTION

In one aspect of the invention there is provided:

A level winder for use on a hose reel, the level winder including:

a carriage operatively connected to a hose guide, the carriage adapted to control the winding of the hose onto the hose reel and to allow the hose to be paid out through the hose guide; and a drive mechanism operating in a drive mechanism plane and carrying at least one drive dog that is adapted to engage a carriage guide on which the carriage is mounted to move the carriage reciprocally along a track, the drive dog and the carriage each travelling in a plane aligned with or substantially parallel with the drive mechanism plane, wherein the carriage guide is aligned in the same plane that the drive dog travels; and the carriage guide comprises at least one curved surface adapted to define a recess and to engage a curved surface of the drive dog, such that at least a portion of the drive dog curved surface is always facing or engaged with the carriage guide curved surface and remains trapped in the recess.

The drive mechanism plane is preferably substantially vertically aligned. The dog preferably travels in a substantially vertical plane. This confers structural and functional advantages on the mechanism, such that the drive mechanism is in line with gravity. This is despite the issues involved in dealing with a dog that periodically changes the height at which it travels, when the vertical height of hose pay out or reeling in, is a factor to be accommodated.

The carriage guide may comprise a pair of opposed generally crescent shaped members. There may be a gap between the carriage guide members that is less than the extent of the drive dog's exterior curved surface. Alternatively, the carriage guide defines a closed circular or shallow cylindrical wall. The carriage guide may be a single block defining a circular recess forming the at least one curved surface.

The dog is shaped so that at least a portion of its exterior curved surface remains in contact with at least a portion of the interior curved surface of the carriage guide, also complementarily shaped, respective to the dog shape. The dog may be in the shape of a disc. The dog may be in the shape of a semi-disc or crescent.

The dog exterior curved surface or wall may be radiused to correspond generally to the radius of the dog curved surface. However, the radius of the interior curved surface or wall of the carriage guide may be greater than, up to double, that of the dog exterior wall. The drive dog may include an outer peripheral flange or lip that engages a top surface of the carriage guide, to facilitate maintenance of its alignment in a plane substantially parallel to the drive mechanism plane. The drive dog may be spaced from the drive chain or belt by an intermediate spacing member.

Accordingly, the dog and the srive chain may operate in different planes, but travel in substantially parallel planes.

The dog may be mounted on a continuous drive loop. The drive loop may be a chain or belt. The chain or belt may be driven by a pair of spaced sprockets or drive wheels that are in turn rotatably mounted on a sprocket or drive wheel shaft. The sprocket or drive wheel may be driven by a primary drive shaft that engages the sprocket or drive wheel shaft through gears. The primary drive shaft may have a longitudinal axis that intersects the vertical plane in which the sprocket or drive wheel shaft lies, but is limited to the vertical space extending above or below the sprocket or drive wheel shaft. The drive wheel shaft may form the leg, and the sprocket or drive wheel shaft the arms, of a T-intersection in plan view. Preferably, the primary drive shaft's longitudinal axis intersects the side profile footprint defined by sprocket or drive wheel shaft. Still more preferably, the primary drive shaft forms a T-intersection with the sprocket or drive wheel shaft and their respective horizontal axes lie, and cross, in a substantially horizontal plane.

The gears may include a bevel gear that is mounted to the sprocket shaft in coaxial relationship. Non-engaging rear faces of the gear teeth may be angled to provide clearance for the passage of the dog as it travels around each sprocket. The enables a more compact design and for the gears to be located adjacent the carriage guide and dog for mechanical advantage. The sprocket shaft may be mounted for rotation on spaced bearings. The bearings may be spaced either side of the gears engaging the sprocket shaft with the drive shaft.

The carriage may dwell at the extreme ends of its travel to allow proper winding or unwinding of the hose or cable at either side of the reel. The drive dog may travel between an upper portion and a lower portion of the carriage guide at the extreme ends of travel of the carriage to allow proper winding or unwinding of the hose at either end of a spool of the reel.

Each sprocket may be removable and replaceable with another different sized sprocket to vary the dwell time of the carriage at the extreme ends of its travel.

In another aspect there may be provided a hose and cable storage reel having a level winder powered from the reel drive system and including a carriage mechanism which allows the hose to be paid out through the carriage, the storage reel being provided with a chain and sprocket drive to initiate lateral movement and reciprocate the carriage upon the level winder device.

The invention also includes a brake means to control the rotation of the spool. The brake means includes at least one roller that can be variably axially offset to provide a frictional retarding force against a rotating wall and a controllable variable braking force. The roller may be alignable to the plane of the spool wall so that its rotating axis is normal to the direction of travel of the wall at the point of contact to allow the roller to be free-wheeling, thereby applying minimal friction to the spool wall. The roller may be mounted to a sprung arm. The sprung arm may be axially rotatable whereby to vary the orientation of the roller axis relative to the direction of travel of the spool wall at the point of contact.

It is preferred that the chain and sprocket drive in the storage reel be provided with at least one specially shaped elongated lobe or dog mounted upon the side of the chain and sprocket drive to initiate lateral movement and reciprocate the carriage upon the level winder device.

The carriage may therefore be permitted to travel in a reciprocating manner back and forth along a linear path in a plane parallel to the chain. The linear path may correspond to a rail on which the carriage is mounted for reciprocal movement. The chain may be mounted as a loop for rotation about sprockets at either end of the rail.

In a preferred arrangement, once the carriage arrives at the end of the rail, the dog lobe rotates about one of the end sprockets, and is allowed to clear this previously engaged first portion of the carriage guide as its direction departs from linear to circular about the sprocket. In this rotational phase it is allowed to clear and pass between the first portion and a second portion of the carriage guide. The dog then begins to travel linearly in the other direction until it engages the second portion that is spaced in the drive plane and preferably vertically from the first portion, the second portion providing the resumed or continued engagement of the dog for return travel of the carriage back along the rail or track. As such, the process is repeated as the carriage reciprocatingly travels back and forth along the rail in alternating directions.

It is further preferred that the carriage mechanism allows for a dwell period at the end of each stroke to facilitate more efficient wrap of the hose at the extremities of the spool. Other designs dictate an immediate change of direction at the end of each stroke. Therefore, at the end of travel in each direction, there may be a controlled pause of movement or dwell time of the carriage whilst the dog transitions from, for example the first portion to the second portion, and the an equal and opposite operation occurs at the other end of the extent of travel to reverse the dog for return travel. This pause may facilitate orderly winding of the hose at the extreme edges of the spool.

It is also preferred that the carriage mechanism allows the hose to be payed out through the carriage at an axis both parallel (0 degrees) and at 90 degrees to the axis of rotation of the drive sprockets on the reciprocator chain. Preferably, the orientation of the sprockets is vertical thereby providing for a more horizontally compact design of significantly reduced depth when the parallel option (0 degree) is chosen. That is the footprint occupied by the hose reel mechanism is smaller. This has advantages for applications where compact design is important, for example, for vehicle-mounted hose reels.

It is further preferred that the carriage mechanism allows for reversing direction in driven mode to prevent the device jamming if the drive is reversed.

It is preferred that the carriage be a disengaging reciprocating carriage device that can be "delatched" from the chain drive by an operator either mechanically or via a solenoid for free unhindered travel of the hose off the spool. This may reduce the load and force required to be applied by the operator during payout of the hose. It is further preferred that the carriage automatically engages on rewind for uniform rewind of the hose onto the spool once the winder is energized. This may be achieved by means of a central cam device actuated via a lever and/or a lever & solenoid device. This will be easily actuated by an operator either remotely or locally. As mentioned earlier, specifically, storage reels generally should allow payout without imposing a drive and/or gearing load. In most instances, this involves the facilitation of "free" manual payout by hand without geared resistance. The nature of this requirement is typically dictated by growing Occupational, Health and Safety (OH&S) requirements in respect of injuries, primarily to an operator's back, caused by the payout resistance of hose reels used by personnel in the work place. In addition, the hose reel need only be able to rewind the hose or cable to be stored and is not designed to apply a pull force to any other mass.

It is further preferred that the carriage mechanism allows for variation in roller position of the hose guide to properly accommodate a large range of typical hose sizes encountered.

It is further preferred that the level wind device allows a simple modification of 3 channel beam components, and two rollers, and chain length, a significant variation in length depending on the hose reel to be fitted to accommodate fitment on to any number of typical hose storage reels. This may involve stand end components interposed with variable length beams. The chain length can be adjusted according standard methods by inserting or removing links, whereas a belt size may be altered by simple substitution.

It is also preferred that the level wind device of the invention be a self contained level wind device independent of the reel frame structure. This would contain all the operable features of the level wind, and can be simply bolted to basic channel support arms retrofitted to any reel type. It would then only require simple chain sprocket or drive belt engagement to an existing drive shaft on any reel to provide the rewind drive.

It may also be preferred that rewinding be facilitated by the provision of a spring forced roller mounted on arms connectible to the storage reel which is directed onto the winding hose.

Furthermore, the level winder device is suitable for use in association with a hose and cable storage reel which permits a range of controls of the winding process on the spool.

The present invention provides a more cost effective, reliable reciprocating mechanism that is readily adaptable to varying reel spool widths in production, along with the ability to retrofit to varying other reel types, including those of other manufacturers. Preferably, the level winder device is a retrofittable, self contained, separable and modular design.

Preferably, a chain and sprocket drive is provided with a specially shaped elongated lobe or dog mounted upon the side of this chain and sprocket drive. It conforms to the profile of one chain link, thus utilising two link pins in the chain for increased load bearing capability. A heavier chain can be used for greater lateral stiffness in supporting the carriage load, as well as accommodating larger heavier reel hose applications.

Upon the inner side of the carriage guide are the one or more internal curved surfaces or walls facing this chain and dog. The dog abuts and actuates against the flat curved face of the interior wall or surface of the carriage guide in one direction to initiate lateral displacement and move the carriage along the rail. Once the carriage arrives at the end of the rail, the dog lobe rotates about the end sprocket as its direction departs from linear to circular about the sprocket. In this rotational phase it travels between the first and the second portion of the carriage guide and then it begins to travel linearly in the other direction until it engages the curved flat face of the other of the first and second portions that diagonally oppose or are angularly spaced from each other. As such, the process is then repeated in the alternative direction.

It is further preferred that a spool mode control be provided comprising a manual lever or solenoid actuated "Mode" selector incorporating three special positions obtained via a rotational slide selector with a gate. It is preferred that an emergency crank rewind that decouples a potentially seized drive motor be provided. Preferably a solenoid is provided which can be actuated to achieve the three optional positions, including engaged, disengaged and crank rewind.

Position 1. Full powered drive

Position 2. Emergency Crank rewind that "uniquely" decouples a potentially seized drive motor.

Position 3. Free (unhindered) spool rotation and payout. The selector also allows the slide shaft to attain free (unhindered) full neutral position where the bevel gears are fully disengaged and the reel spool is completely free running to allow easy pay-out of the hose without the resistance of the motor and reduction gearing. Once the level winder device is also disengaged to be in neutral, there is nothing at all to hinder the free lateral movement of the hose moving off the spool during payout.

It is also preferred that an integrated PTO (power take oft) be provided to operate the level winder.

It is further preferred that an integrated optional emergency bevel gear crank rewind with adjustable crank angle be provided. It is further preferred that a side mount chain sprocket cartridge unit that allows for quick ratio changes of predetermined sprocket sets to set correct level wind speeds of varying hose sizes be provided.

The spool mode control comprises a primary sliding output shaft providing sliding interconnectivity to the static integrated PTO (Power take off to operate the level winder) along with the integrated optional emergency bevel gear crank rewind with adjustable angle crank combined secondary output shaft which in turn drives the chain sprocket reduction drive cartridge (a side mount chain sprocket cartridge unit that allows for quick ratio changes of predetermined sprocket sets to set correct level wind speeds of varying hose sizes) and finally the level winder itself.

The sliding functionality is provided via a simple fork and pin sliding joint arrangement. The primary sliding output shaft in the device comprises two spur gears of varying sizes, with unique side bevel cut teeth upon the outboard side, cut in a way that allows for the axial meshing of both gears into two corresponding gears set upon a parallel shafts, one for each gear, one being a power input shaft connected to a motor drive, the other being a shaft providing the final direct drive input into the spool. The continued meshing of these gears facilitates both the drive function of the spool, along with the engagement of the level wind device. In this case the crank drive would also be live however in this instance the crank handle will be removed. This meshing of gears is maintained by an axial thrust force being applied to the slide gear and slide shaft say via a light actuation spring, a powered solenoid, or by this shaft being locked into place via a special selector gate mechanism that rotates about the device housing.

It is further preferred that an overload safety function be provided. This includes another special side cut bevel gear axially fixed with a limited sliding action upon the parallel power shaft within the device driven by an electric motor or other power source which has fixed directly to it a typically smaller drive gear with a mating axial bevel cut. This small drive gear is normally held engaging this special shaft gear of limited sliding action. The large side cut gear with limited sliding action is forced against the motor drive side cut gear continually via a preloaded heavy spring acting upon it about the shaft, and is able to apply an adequate force to ensure the duty of the reel is fulfilled, but if the reel is compelled to stall due to a jam or excessive load, the side cut bevel gears being forced together by the spring will push apart due to a load in excess of the springs pressure.

The spring pressure can also be adjusted via a pretension bolt or similar. The special side cut of the meshing bevel gears allows for adequate power transmission whilst the gears are held in mesh by the spring, however when a load exceeds the springs compressive load the gears are allowed to move axially out of mesh by the superior pull load of the hose being rewound against the lesser spring load, to allow slippage. Therefor they act as a safety clutch device. This spring load may be adjusted by means of a screw applying for compressive load to the spring, therefore adjusting the slip rate of the reel.

It is also preferred that the mode selector device be designed as a mirrored unit in that the selector mechanism sleeve can be reversed as a mirror to allow the matching gears to be normally engaged with each other or normally disengaged, depending upon the arrangement of the slide components which are uniquely designed to be reversible to facilitate such modes. Two locating rings attached via grub screws contain the selector sleeves and provide for the setting of the selector positions and act as fixed limits.

It is further preferred in the invention that a resistance wheel brake acting on spool disc be provided. The wheel brake may be a simple rolling rubber wheel. The roller wheel may be mounted to a screw adjustable axial spring preload that applies varying resistance pressure to the periphery of the spool disc as it rolls around. The resistance may be increased by tightening the screw. The rubber wheel can also be swung around to provide rolling resistance via a lever actuator.

This resistance continues to increase as the rubber roller is swung a full 90 degrees, at which it discontinues to roll and locks up. This may be when it has no forward vector urging rolling motion in the direction of the spool disc at the point of engagement. This provides maximum resistance to rotation and full braking of the spool to prevent rotation, for example, during vehicle motion or hose storage, etc.

In a further embodiment of the invention a spring pressured roller is provided on arms attachable to the storage reel to provide pressure on the winding hose loops thereby facilitating their orderly distribution.

The invention provides in a hose and cable storage reel a means for distributing the hose upon the reel in an improved manner provided by a variety of unique means. In particular the invention is able to be applied to a wide variety of spool widths without the need for a specific level winder to be provided for any given reel dimension.

BRIEF DESCRIPTION OF THE DRAWINGS

Possible and preferred features of the present features of the present invention will now be described with particular reference to the accompanying drawings. However, it is to be understood that the features illustrated in and described with reference to the drawings are not to be construed as limiting on the scope of the invention. In the drawings.

DETAILED DESCRIPTION OF THE DRAWINGS

Figure 1:
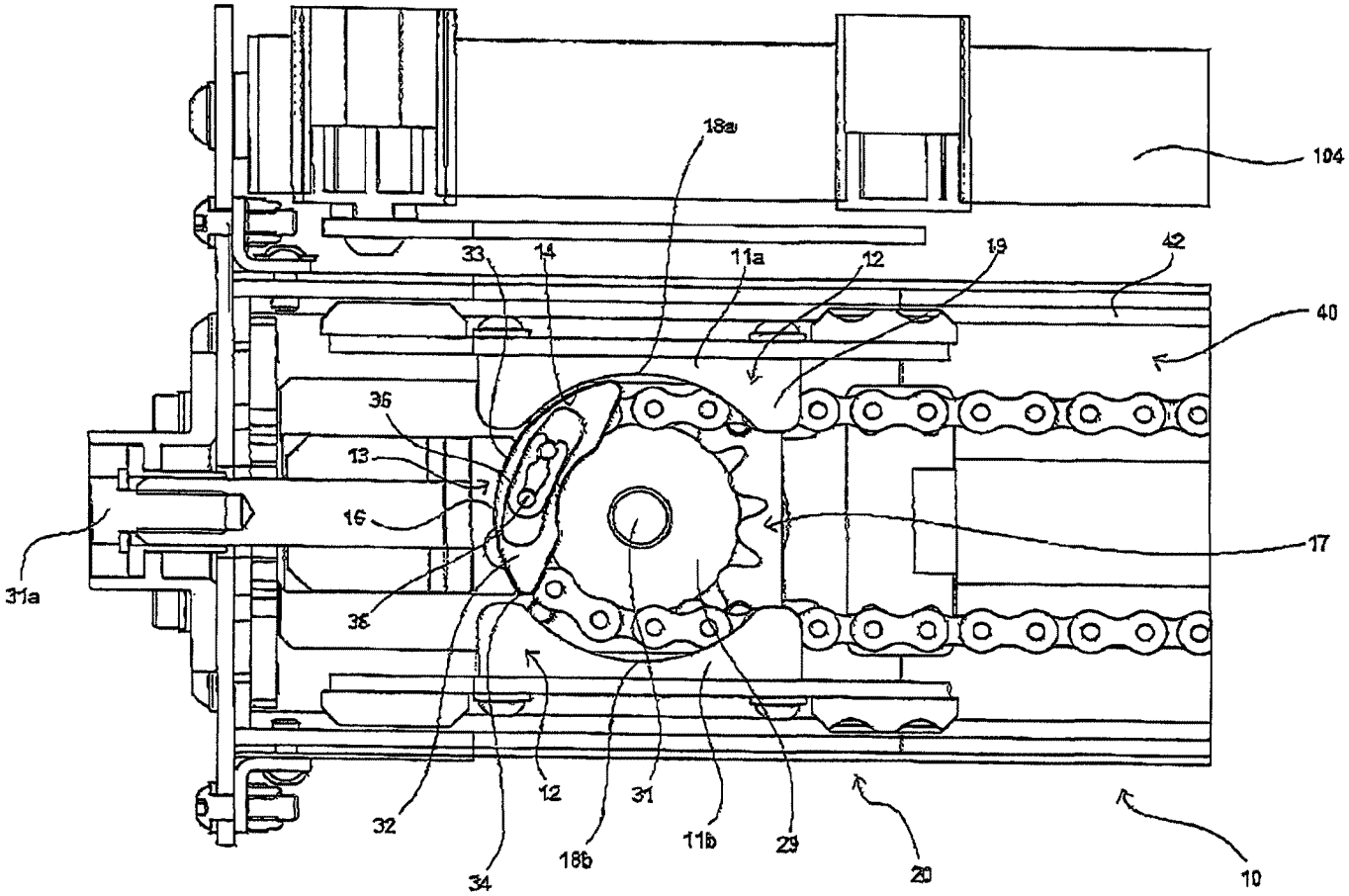
FIG. 1 is a front view of a drive for a level winder having a pair of opposed arc dog guides blocks according to one embodiment of the invention.

Referring to the drawings, there is shown a variety of level winder devices for use in association with a hose and cable storage reel which permits a range of controls of the winding process on a spool.

Figure 7:
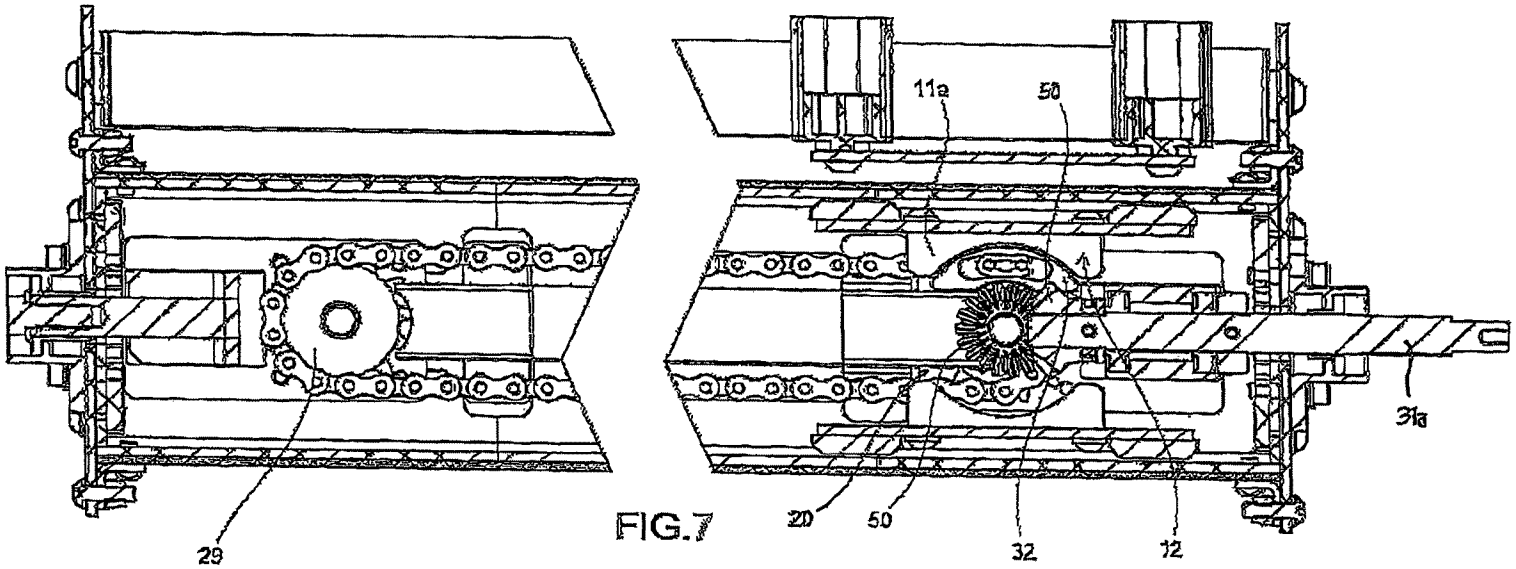
FIG. 7 is a front elevation of the level winding mechanism shown in FIG. 6.
Figure 8:
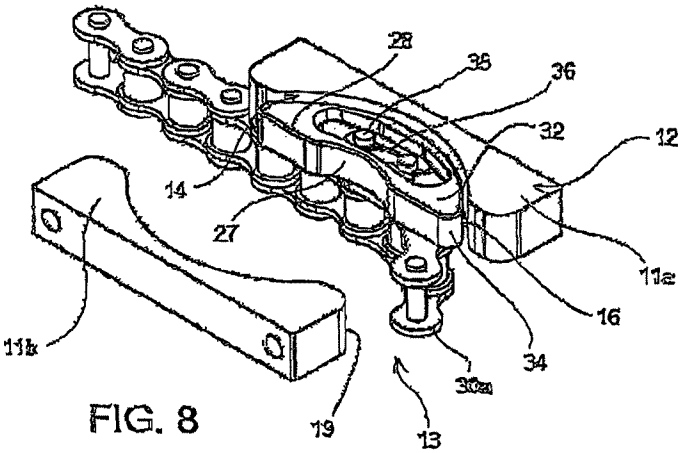
FIG. 8 is a partial perspective view of the chain dog and dog guide of the level winding mechanism shown in FIG. 6.

Referring to FIG. 1, a drive mechanism in the form of a tensioned chain 30 (not shown in FIG. 1) for a level winding mechanism 10 is provided according to an embodiment in which a chain dog engagement means is shown in the form of opposed part circle or arc-shaped carriage guides 12. A drive shaft 31 is operably connected to vertically oriented sprockets 29 which carry the tensioned chain 30. The drive shaft 31 is connected by bevelled gears 50 (see FIGS. 7 and 8) to a primary drive shaft 31*a* extending normally relative to the drive shaft 31 and longitudinally of a beam 40. The gears 50 if shown in FIG. 1 would extend out of the page into the region between the carriage guides 12. The gaps 13 between the carriage guides 12 are sufficient to allow the carriage guides to travel passed the bevelled gears, thereby permitting a more compact arrangement in the dimension parallel to the axis of the drive shaft 31. The chain 30 carries a crescent or arc-shaped dog 32 that engages the carriage guides 12 by its broad radiused convex outer wall 16 against the internal curved concave walls 14 of the carriage guides 12 whereby to move a carriage 20 along rails 42 formed as flanges out of the beam 40. The chain dog engagement means is thus in the manner of a scotch yoke, the chain dog 32 effectively trapped within the confines of a circular region 17 generally defined between the carriage guides 12. The dog 32 is generally radiused to form a section of a circle having a radius that matches the general dimensions, that is the radius if the internal concave walls 14 of the guides 12. The dog 32 is attached to the drive chain 30 with a circlip arrangement 36 and connected to adjacent pins 35 on a single link of a chain 30, the curved length of the dog 32 extending well-beyond the length of the attached chain link to ensure that the gaps 13 between opposed guides 12 are bridged by the the dog 32 as it transitions the carriage 20 from one direction to the other as dog 32 moves with the chain 30 around the sprocket 29. This ensures that the dog 32 is in contact with at least one or other of the guides 12 at any one time. The dog 32 will generally complete a transition from bearing on a first upper carriage guide 11*a* to bearing on a second lower carriage guide 11*b* as it travels around the sprocket 29 when the center of its curve 33 departs from the curve centre 18*a* of the upper carriage guide 11*a* to the curve centre 18*b* of the lower carriage guide 11*b*. As shown in FIGS. 7 and 8, the curved surfaces 14, 16 generally broadly engage with each other to spread the abrasive and fatigue load and reduce wear, helping preserve these wear parts 12, 32 for longer. The ends of each part 11*a,b* of the dog 32 taper to narrow radiused ends 34. The radiused ends 34 facilitate smooth engagement with the concave surfaces 14 of the carriage guides 12. The ends 19 of the carriage guides 12 are flattened to provide a strong end wall and permit the passage of the bevelled gears travelling therebetween.

There is a predetermined and constant dwell time at either end of the reciprocal travel of the carriage 20. The sprocket 29 size is optimised for mechanical strength, speed of linear travel of the carriage 20 carried by the chain 30 and space constraints within the carriage 20. However, the sprocket 29 size is generally fixed for any particular level winding mechanism 10, so that the dwell time associated with this compact arrangement of the level winding assembly 10 is generally fixed.

Figure 11:
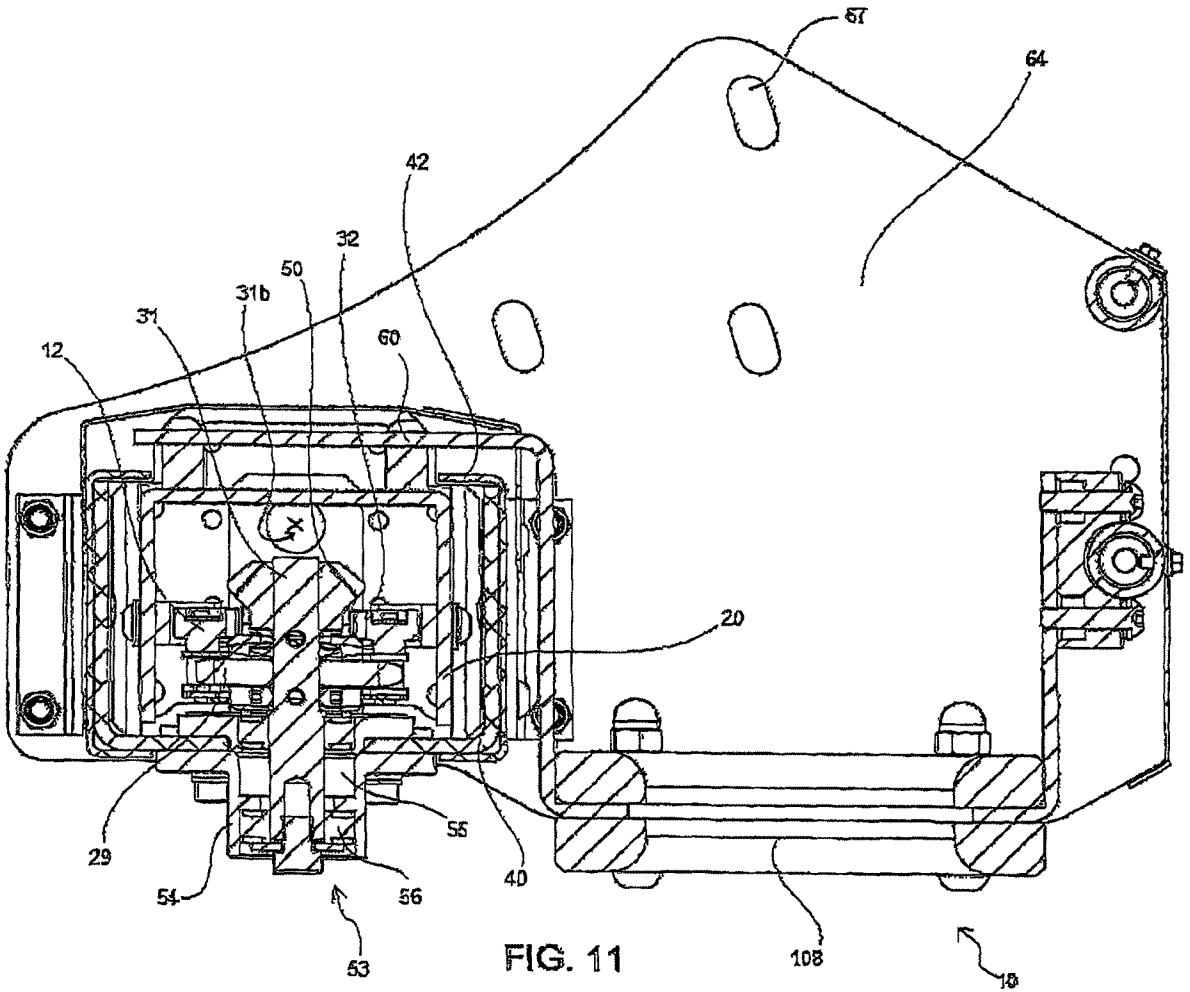
FIG. 11 is a side sectional view of a compact level winding mechanism having no front guide rollers according to another embodiment in which the roller 108 would normally be oriented towards the front and towards the top of the mechanism.

The carriage 20 is mounted on the level winding assembly 10 for linear reciprocal motion along the rail 42 extending between the ends of the level winding assembly 10. The level winding assembly 10 includes a drive means including a drive shaft 31 operably engaged to a variable level wind speed gear or reduction mechanism 130 as shown in FIG. 11 of WO2012/135890. The level winder drive mechanism 10 of the present embodiment now described includes bevelled gears 50 adapted to engage with vertically aligned and spaced sprockets 29 that lie in the same plane at either end of the rails 42 and are adapted to drive the tensioned chain 30. The chain 30 comprises a loop that travels in a vertical plane corresponding to the plane of the spaced sprockets 29.

The carriage 20 is adapted to reciprocate along a linear pathway defined by the beam 40. The beam 40 has a channel shape formed by the rails 42 forming side flanges of the channel. The carriage is trapped in the channel shaped beam 40 which extends in length the equivalent of a substantial proportion of the length of a horizontal roller 104 passed which hose or cable is paid out or wound in. The beam 40 defines the extent of reciprocal movement and travel of the carriage assembly 20. Attached to this specification is Annexure A entitled "Level Wind Design Dwell Time Consideration" that explains the engineering principles associated with the reciprocal movement of the dog 32 and the carriage 20 and other dogs and carriages described in this specification.

Figure 2:
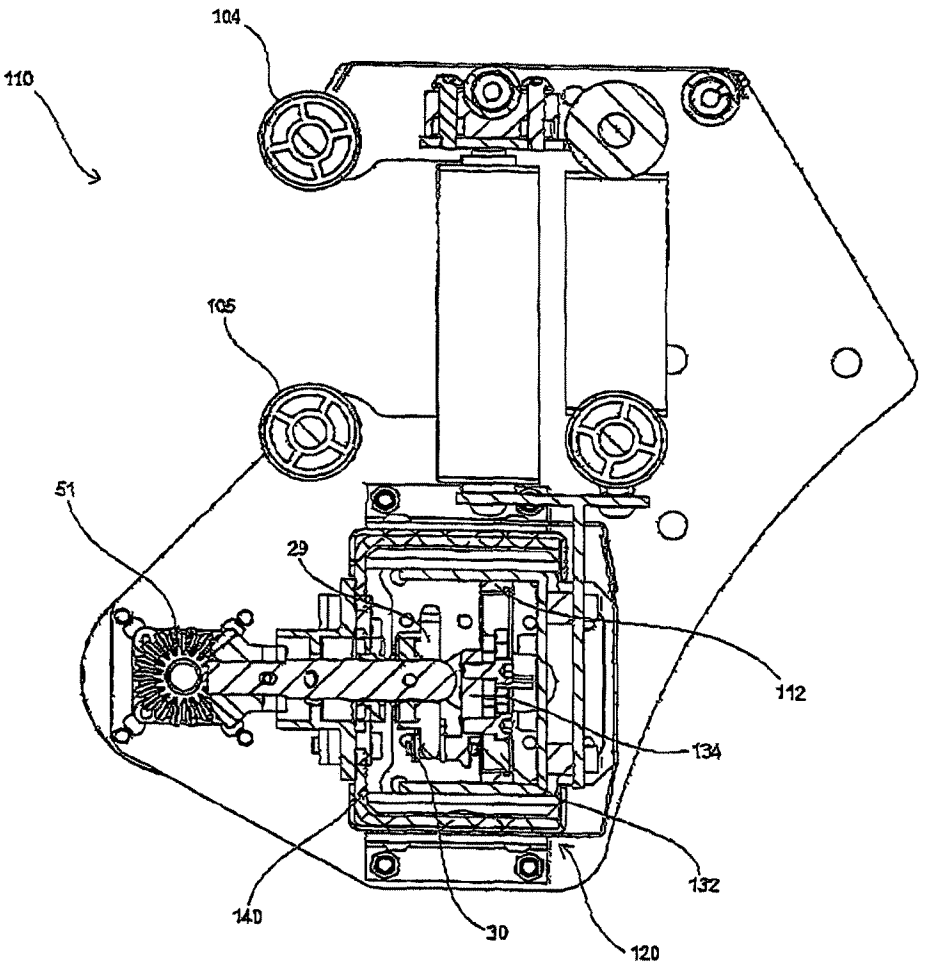
FIG. 2 is a side section view of a level winder having a full circular chain dog guide block and front and rear guide rollers according to another embodiment of the invention.
Figure 3:
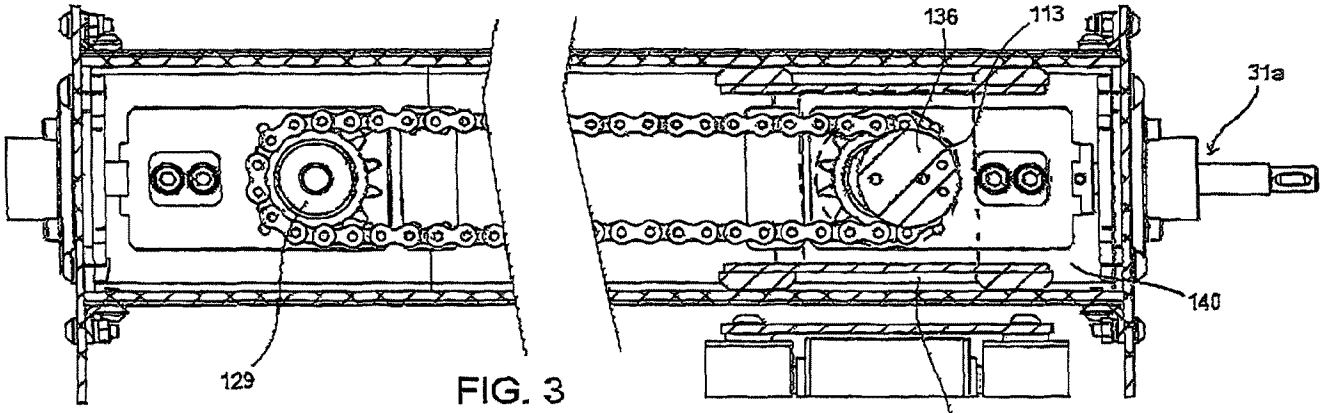
FIG. 3 is an is a front elevation of a level winder shown in FIG. 2.
Figure 4:
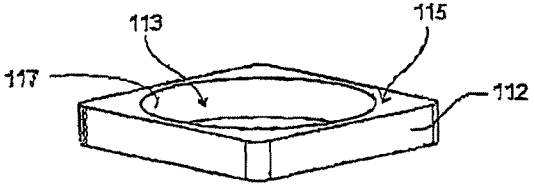
FIG. 4 is a perspective view of the guide block shown in FIG. 3.

In FIG. 2 there is shown another embodiment in which like components are referred to using like reference numerals. A level winder 110 has a bevel gearing 150 that extends out frontwards from the line of a pair of front horizontal rollers 104, 105. The gearing mechanism 150 is moved in front of a carriage 120) and permits an arrangement in which a dog extension 132 can be controlled by a complete, unbroken circular doughnut shaped carriage guide 112 completely traps the dog extension 132 in an inner circular recess 113 defined by an inner circular or cylindrical curved wall 114. To ensure minimal play between the carriage guide 112 and the dog extension 132, as shown in FIG. 5*b*, the dog extension 132 may include a predominantly cylindrical or circular external wall 116 capped with an outer lip 135 that is adapted to extend over the upper surface 115 of the carriage guide 112. The external wall 116 rides and abuts against an internal wall surface 117 of the carriage guide 112 that defines the recess 113. Accordingly, if there is some inherent play due to the interaction between the chain (or a belt) 30 and this is transmitted through the dog extension 132 to the carriage guide 112, this play will be minimised by the provision of the outer lip 135 and its interaction with the upper surface 115.

Figure 5C:
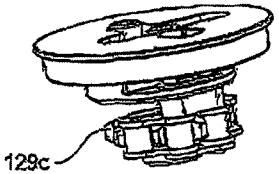
FIGS. 5*a*-5*c* are perspective views of chain dog and engagement mechanisms shown in FIG. 3.
Figure 5B:
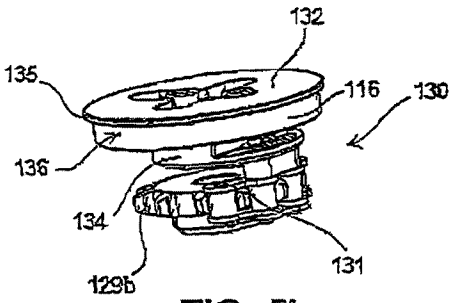
Figure 5A:
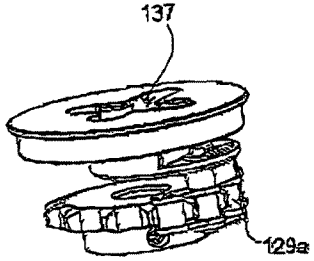

In FIGS. 5*a*-5*c* the dog extension 132 is shown to form part of a stacked extension arrangement 130. The stack 130 comprises a chain link mounting member 131, an intermediate spacing member or chain dog 134 and the dog extension in the form of a circular disc 136 mounted outermost by means of threaded bolts extending into threaded bores in the dog 134. The circular outer wall of the disc 136 engages the inner circular recess of the carriage guide 112. The carrier guide 112 is in the form of a square block having the circular recess 113, the block 112 being mounted to a carriage 120. An array of apertures 137 extending through the dog extension disc 136 are positioned to permit the disc 136 to be mounted to the dog spacer 134 with variable or adjustable eccentricity.

This provides a means to vary dwell time as the carriage 120 transitions from moving in one linear direction to moving in the opposite direction.

Dwell times at the extremes of travel of the carriage 120 along a beam 140 may be varied by changing the size of the sprockets 129*a-c* respectively shown in FIGS. 5*a*-5*c*. Assuming a constant rate of rotation, changing the sprocket 129*a-c* size and teeth number will vary the time that the disc 136 spends travelling linearly on a chain 30 (not shown) between the sprockets 129*a-c*. However, by using the variable speeds afforded by the gearing associated with the drive mechanism 131*a*, the RPM of the drive shaft 31*a* may be varied to achieve the desired linear speed and to vary the dwell time. For example, a short dwell time can be achieved by using a small 8 teeth sprocket 129*c* as shown in FIG. 5*c*. A longer dwell time can be achieved by using a large 15 teeth sprocket 129*a* as shown in FIG. 5*a*.

The stack 130 is bulky compared to the drive mechanism 30 of the first embodiment but has the advantages of enabling variability of dwell time, a smoother operation due to more constant contact of bearing parts 136, 112 and reduced wear of the bearing wear parts due to broader contact surfaces that spread the abrasive load.

Figure 6:
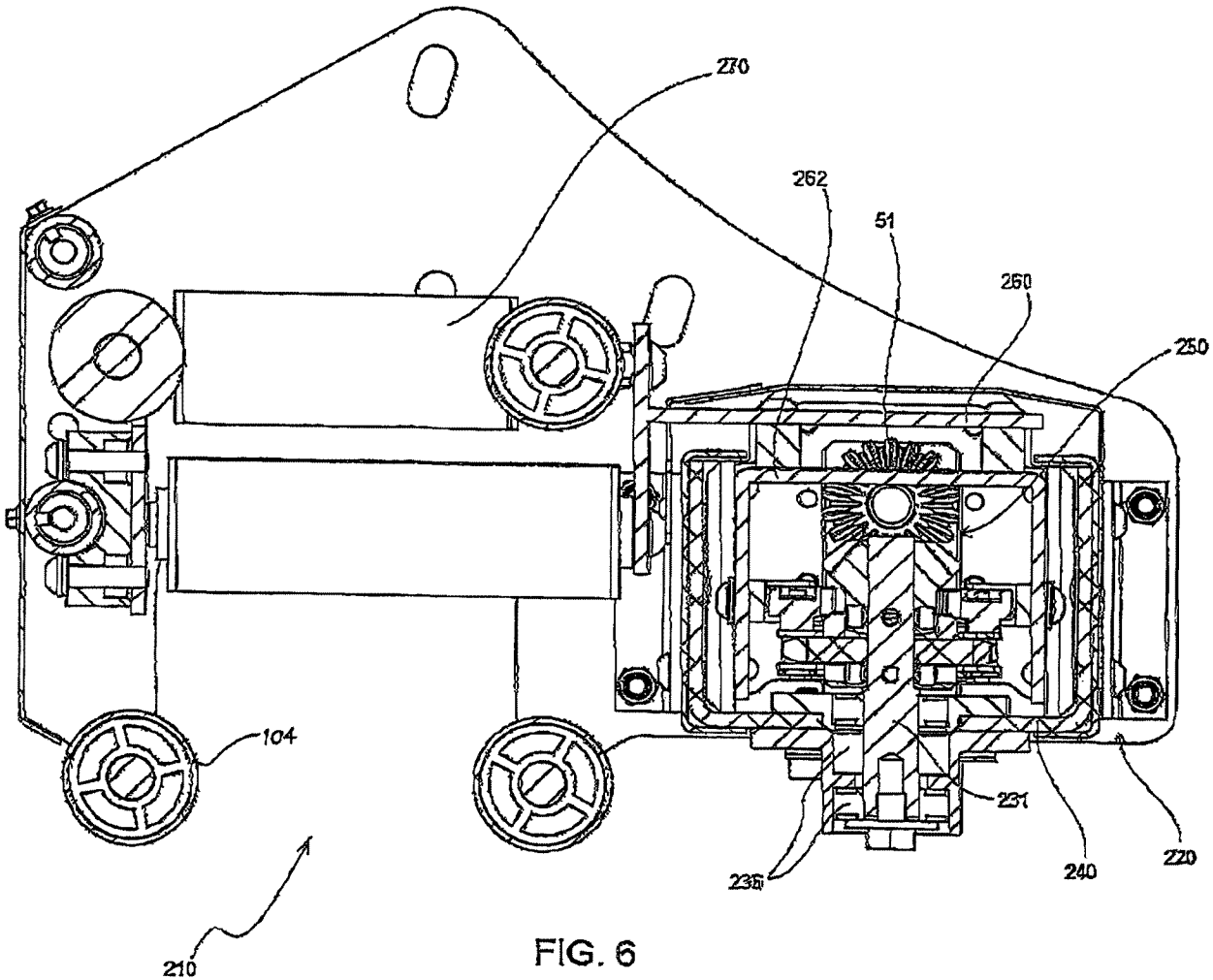
FIG. 6 is a side section view of a compact level winding mechanism according to another embodiment in which the roller 104 would normally be oriented towards the front and be positioned uppermost.

In FIG. 6, there is shown a level winder 210 in side view to demonstrate its compact nature. The width of the beam 240 is substantially narrower compared to the width of the beam 140 plus gearing 150 in the embodiment shown in FIG. 2. The gearing 250 is within a narrower side elevation footprint of the carriage 220 and the sprocket drive shaft 231 bearings 236 can be positioned front or back (in this case at the front of the level winder 210) to cantilever the sprocket shaft 231. A rear mounting bracket 260 attached to a back plate 262 of the carriage 220 supports the hose-guiding rear vertically-aligned rollers 270 which are desirable but not essential to minimise wear and tear on the hose or cable.

In FIGS. 7 and 8, there is shown an embodiment similar to that of FIG. 1 in which the chain dog 32 has a compact design comprising a crescent-shaped dog 32 attached to a chain link 30*a* by engagement to extended chain pins 35 and a circlip 36. The carriage guide 12, and hence the carriage 20, sit close to the chain 30 (not shown) and permit a very compact arrangement in terms of front-to-back space, which can be very desirable in applications where space is at a premium.

The crescent chain dog 32 has an outer curved surface 16 that extends at least as long as (and with a similar radius as) the arc defined by the gaps 13 between each opposed arc-shaped parts 11*a, b* of the carriage guide 12. Therefore, the dog 32 is constantly in contact with at least one of the inner curved surfaces 14 of the carriage guides 12, and with both of the inner curved surfaces 14 when the chain dog 32 straddles the gap 13 with its dog ends 34 extending to each guide end 19.

Figure 9:
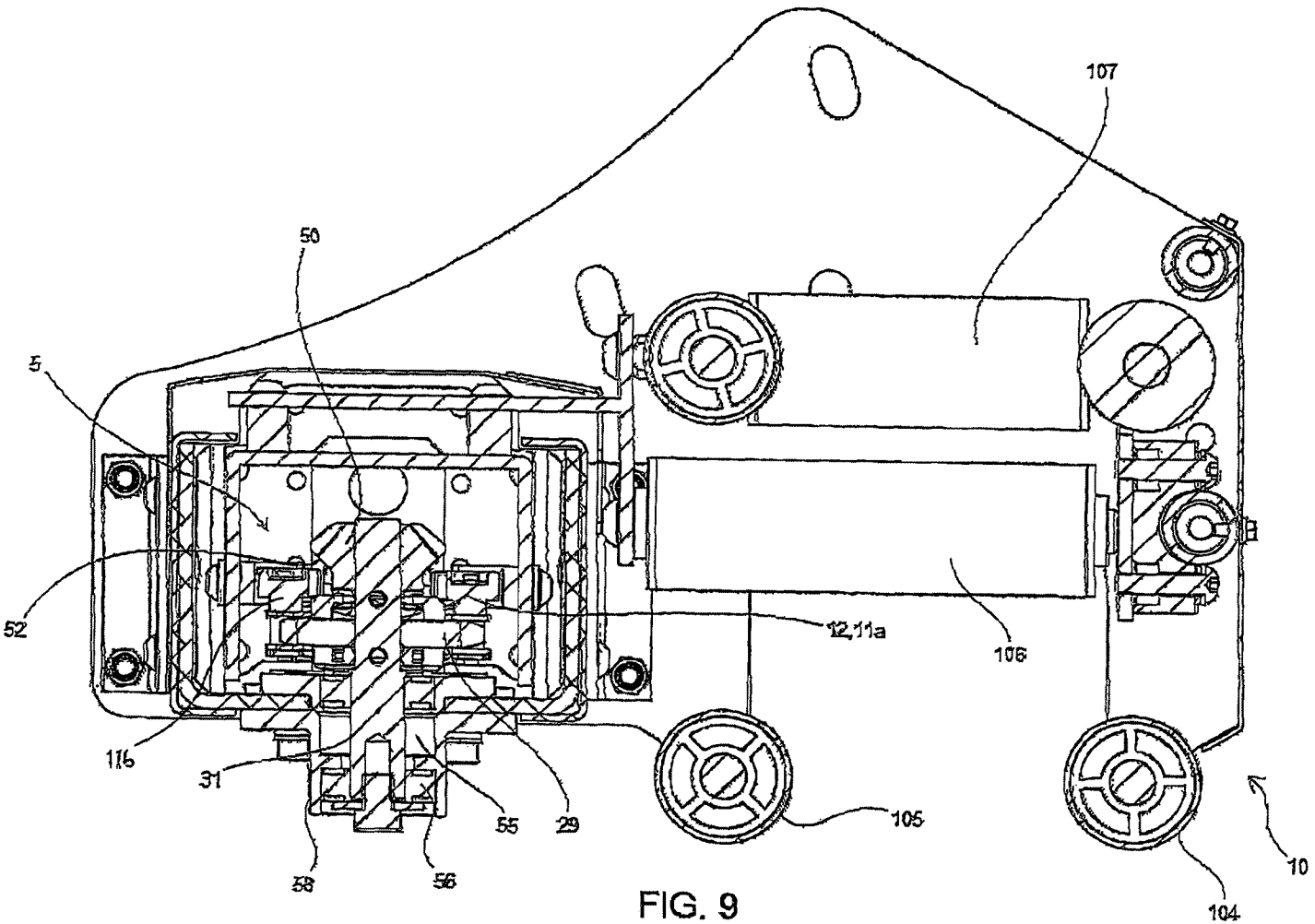
FIG. 9 is a side sectional view of a compact level winding mechanism having multiple guide rollers according to another embodiment in which the roller 104 would normally be oriented towards the front and be positioned uppermost.

FIG. 9 shows a compact level winder arrangement 10 similar to that of FIG. 1. The level winder 10 includes front horizontal rollers 104, 105 and multiple vertical rollers 106, 107 that ensure minimal wear and abrasion for the repeatedly paid out hose or cable (not shown). The side view of FIG. 9 illustrates the space 5 shared by the gears 50 and the generally circular space 17 defined between the opposed upper and lower curved guides 11*a, b* of guide 12 in which the chain dog 32 moves.

The inner curved recess 27 at the inner centre of the dog 32 further clears space for the bevelled gears 50 and permits the largest possible gears 50 in the space 5 available for strength and smoothness of operation, the underside 52 of the gear tooth blades being angled at about 40°-50°, and prefereably about 45°, for strength and to clear the proximal inner edge 28 of the dog 32 (see FIG. 8).

Figure 10:
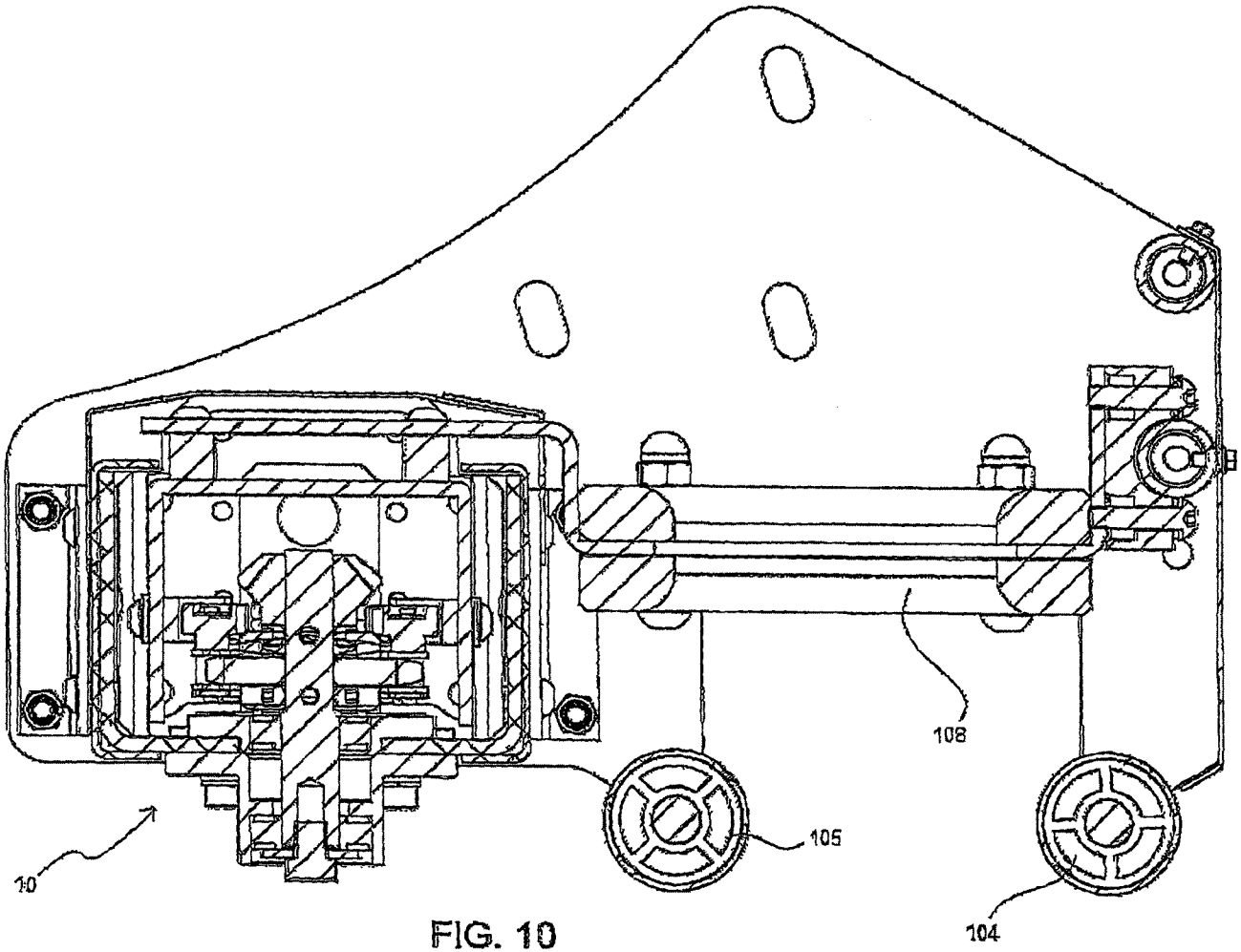
FIG. 10 is a side sectional view of a compact level winding mechanism having front guide rollers according to another embodiment in which the roller 104 would normally be oriented towards the front and be positioned uppermost.

In FIG. 10, the compact level winder 10 is combined with a hose guide 108 that comprises a doughnut shaped large aperture through which the hose or cable is fed. The hose guide 108, may be made of a low friction material such as PTFE (such as that supplied under the brand name Teflon®) that is aneconomical compromise to the provision of more expensive vertical roller guides 106, 107, but with the horizontal rollers 104, 105 still retained.

Figure 12:
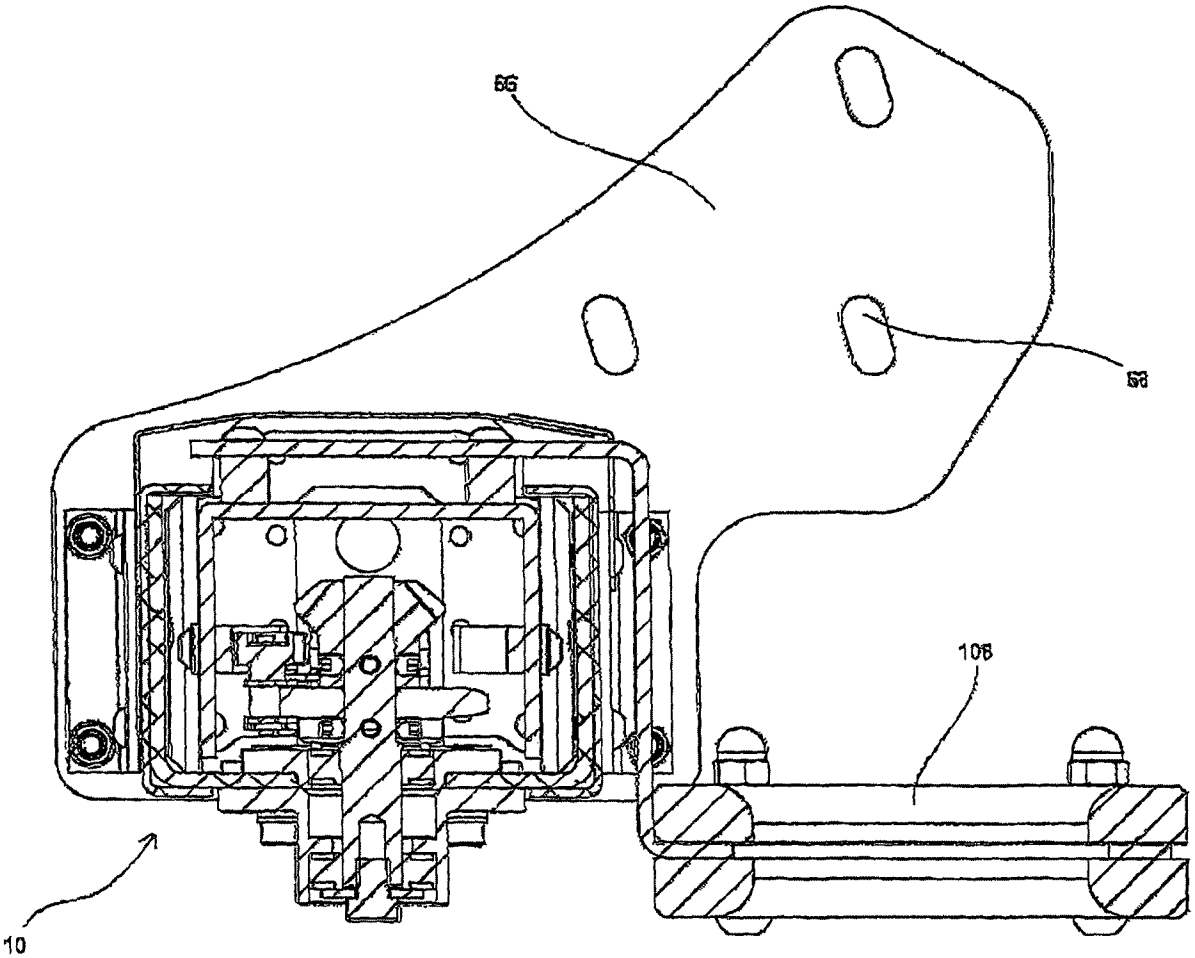
FIG. 12 is a side sectional view of a compact level winding mechanism having no front guide rollers according to another embodiment in which the roller 108 would normally be oriented towards the front and towards the top of the mechanism.

In contrast, in FIG. 11 an even cheaper alternative is shown where only a doughnut hose guide 108 is provided, so that the horizontal rollers 104, 105 are not included. A bracket 60 support the hose guide 108. It is sufficiently rigid and strong to support the doughnut hose guide 108 standing proud above the level winder 10, without further reinforcing, such as side panels 64. However, for practical and marketing reasons, the side panels 64 have other, e.g. brand location and instruction placement, advantages that warrant their inclusion. Such an arrangement is illustrated in FIG. 12, where side panels 66 serve the purpose of providing a consistent location for mounting apertures 68, but otherwise does not assist in the support of the doughnut hose guide 108.

Figure 13:
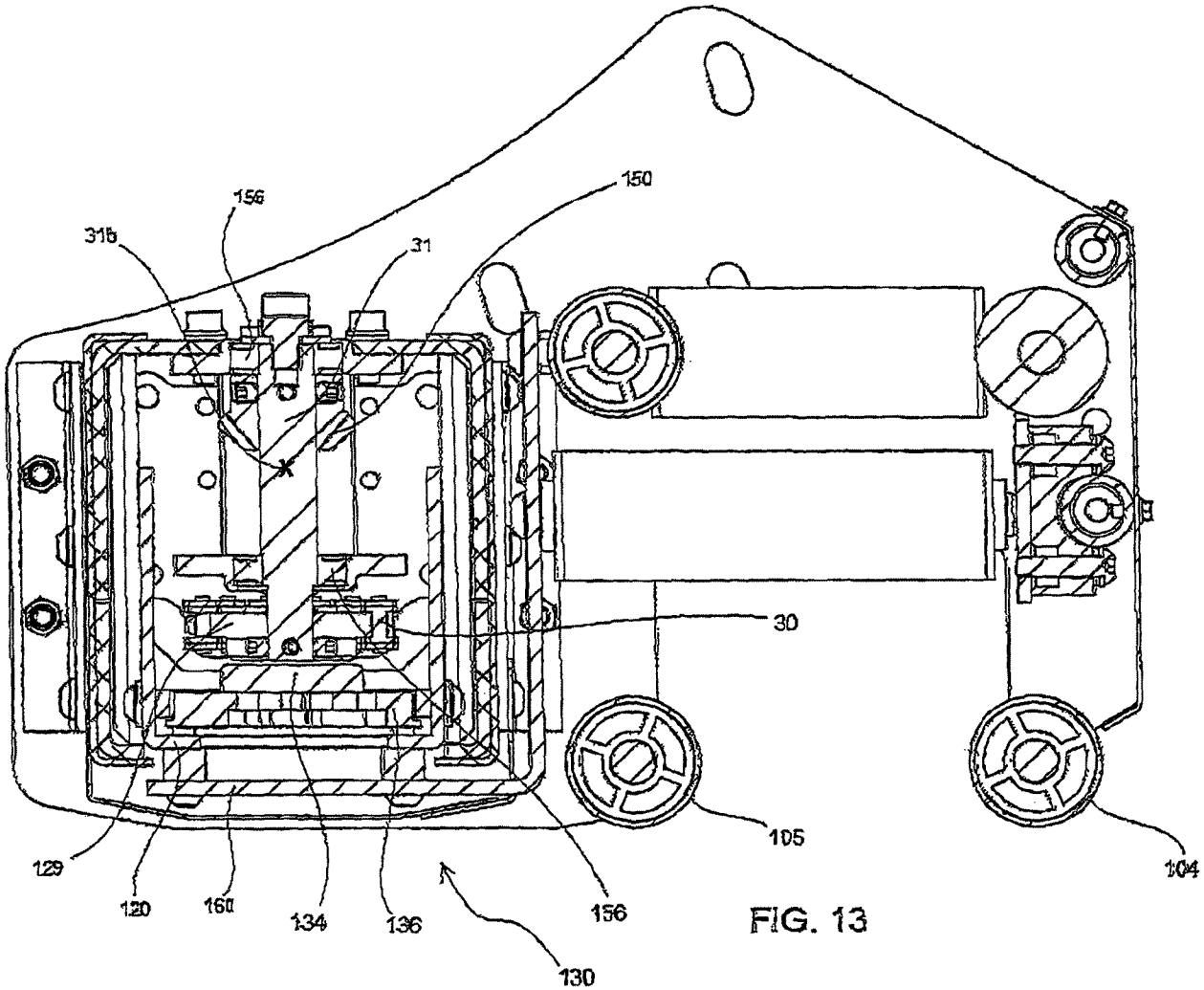
FIG. 13 is a side sectional view of a compact level winding mechanism having a complete set of guide rollers according to another embodiment in which the roller 104 would normally be oriented towards the front and be positioned uppermost.
Figure 14:
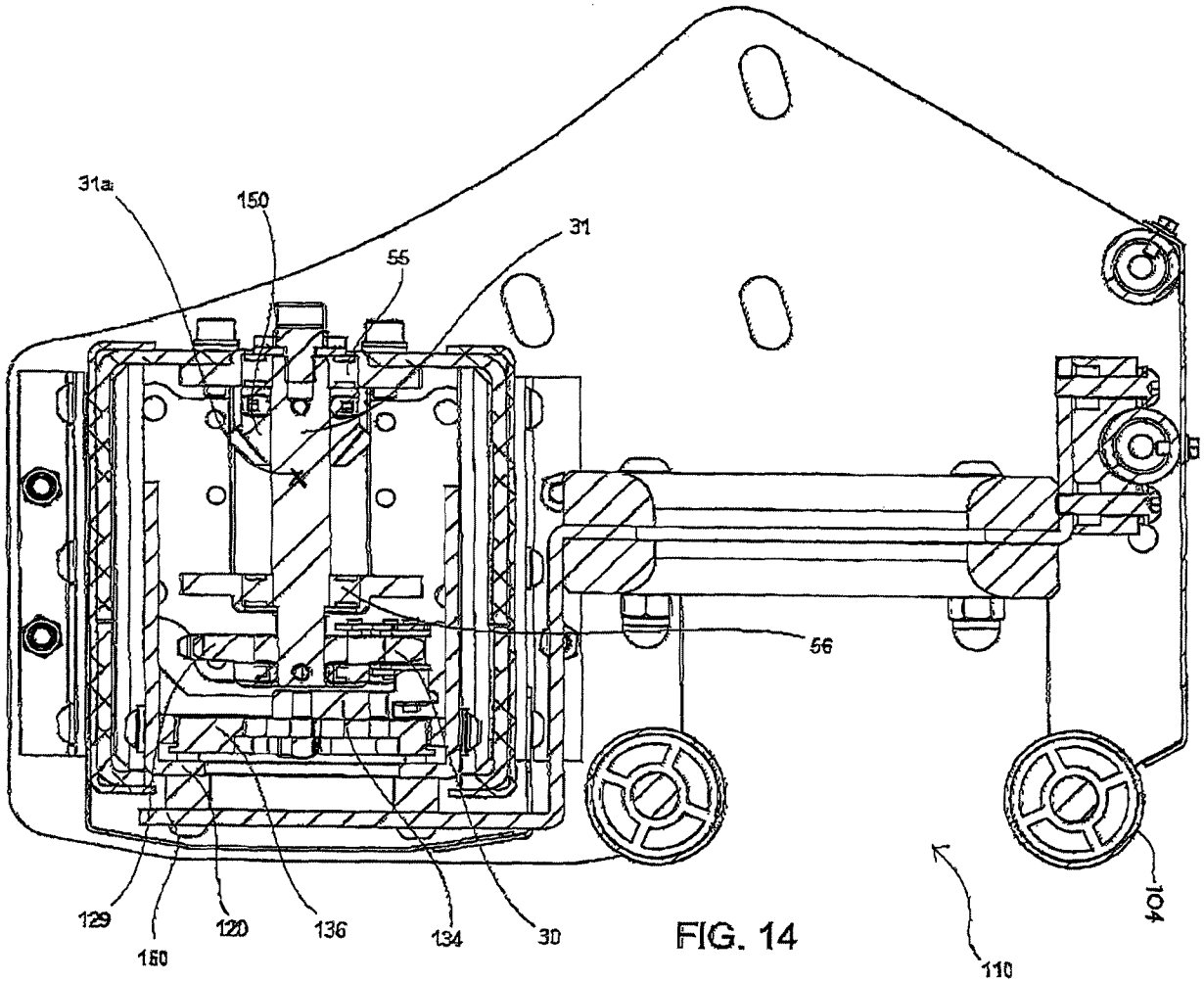
FIG. 14 is a side sectional view of a level winding mechanism having front guide rollers according to another embodiment in which the roller 104 would normally be oriented towards the front and be positioned uppermost.

FIGS. 13 and 14 are stacked extension arrangements 130 including a full disc dog extension 136 similar to that shown in FIGS. 2-5*c* and illustrates the extremely compact arrangement of the stacked dog arrangement 130 by the clever placement of the primary drive shaft 31*a*. Spaced sprocket shaft bearings 155, 156 support the sprocket drive shaft 31 at positions along a substantial length of the sprocket drive shaft 31, with the sprocket 29 supported in cantilevered relationship at the front or disc 136 end of the sprocket drive shaft 31. The side elevation footprint of the stacked arrangement 130 is essentially the sum of the width of the rear-most bearing 155, the sprocket drive gears 150, the front-most bearings 156, the sprocket 129, the bush dog 134, the dog extension disc 136, the carriage 120 in the form of a housing and a vertical roller support bracket 160, preferably in that order.

Figure 15A:
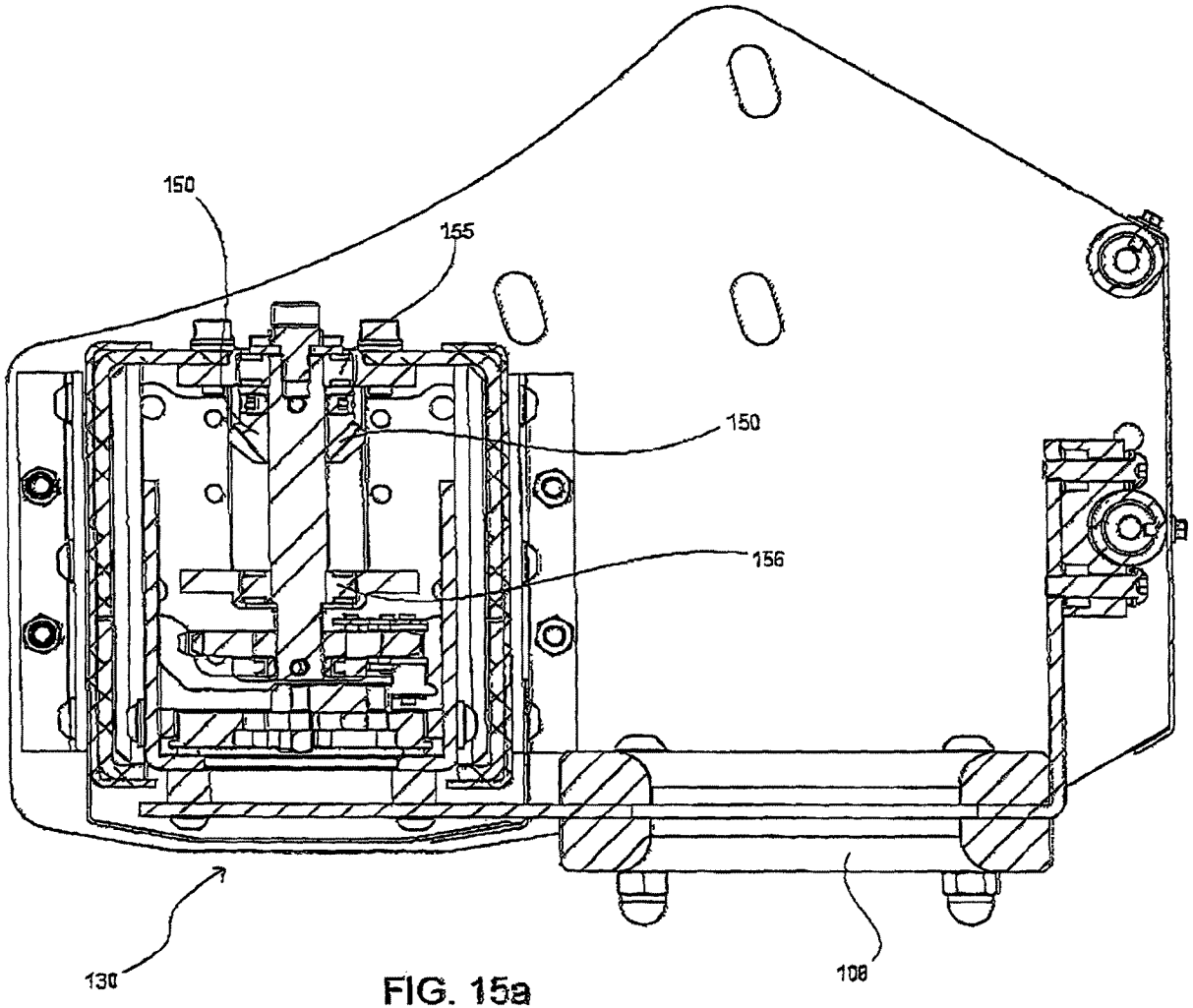
FIG. 15*a* is a side sectional view of a level winding mechanism having no front guide rollers according to another embodiment in which the roller 108 would normally be oriented towards the front and towards the top of the mechanism.
Figure 15B:
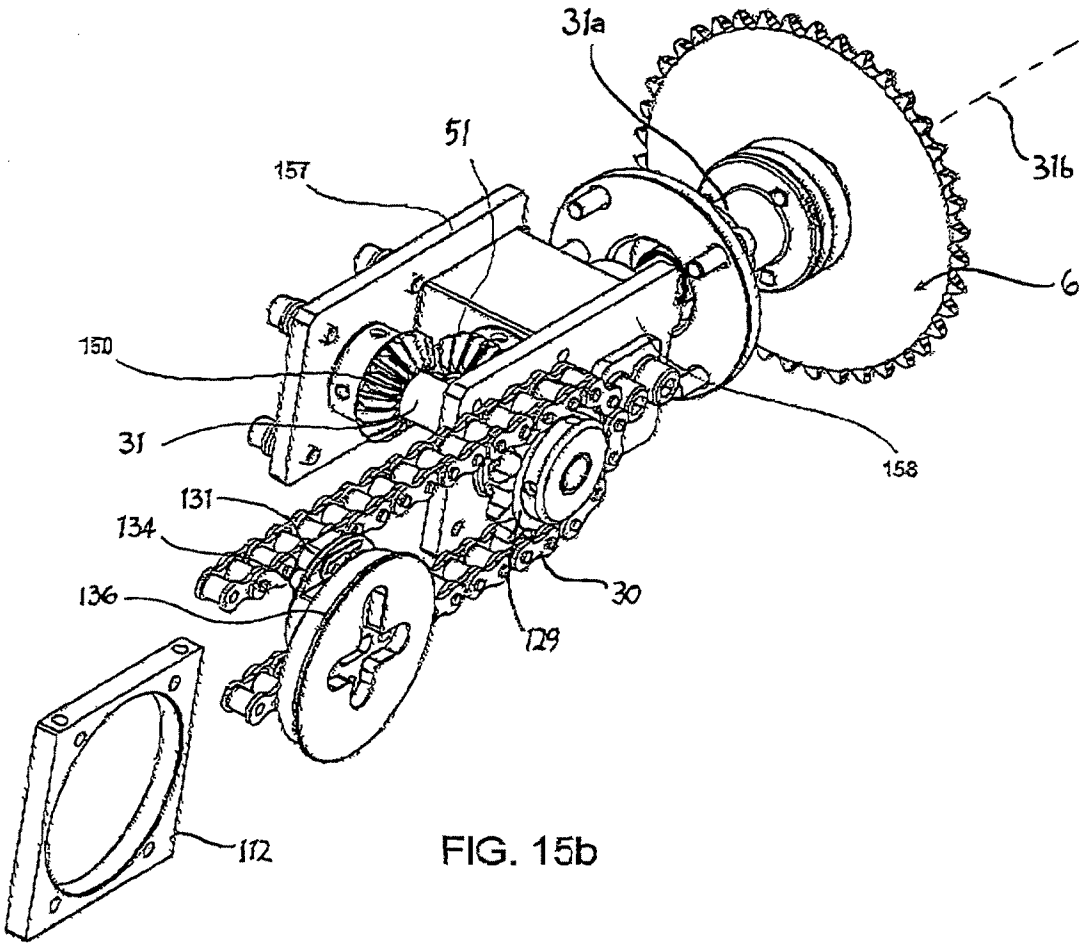
FIG. 15*b* is a perspective view of a portion of the drive components of the level winding mechanism shown in FIG. 15*a;*

In particular, as shown in FIGS. 15*a* and 15*b*, the spacing of the bearings 155, 156 and their respective support plates 157, 158 either side of the bevelled gears 150 permits a compact arrangement 130, whilst still allowing for the stacking of the component parts in the arrangement 130 which is required to clear the complete circular recessed carriage guide 112. FIG. 15*a* also demonstrates that a simple doughnut hose feeder 108 may be adequate to feed off and pay in the hose or cable, depending on the level of use of the reel.

The achievement of various narrow and compact versions of the level winders 10, 110, 210 enable many of the same extraneous or modular components to be used for all types according to the invention, thereby cutting down on manufacturing costs. It is noted that the embodiments 10, 110, respectively shown in FIGS. 10 and 14 can be fitted in a similar space to reduce manufacturing costs and increase production volumes.

Figure 16:
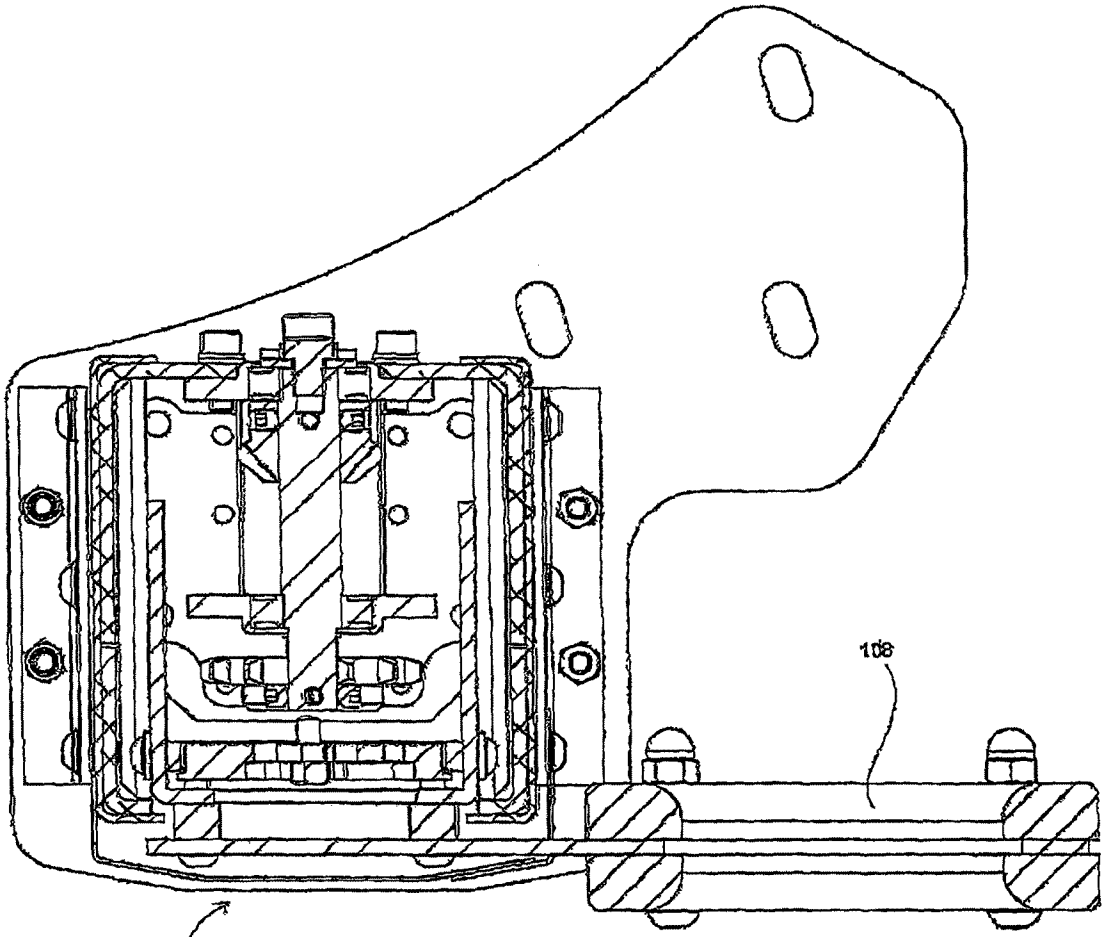
FIG. 16 is a side sectional view of a level winding mechanism having no guide rollers according to another embodiment in which the roller 108 would normally be oriented towards the front and towards the top of the mechanism.

FIG. 16 shows a variation on the embodiment shown in FIG. 12, where the compact level winder arrangement 10 is substituted for the stacked narrow or compact arrangement 130.

Figure 17:
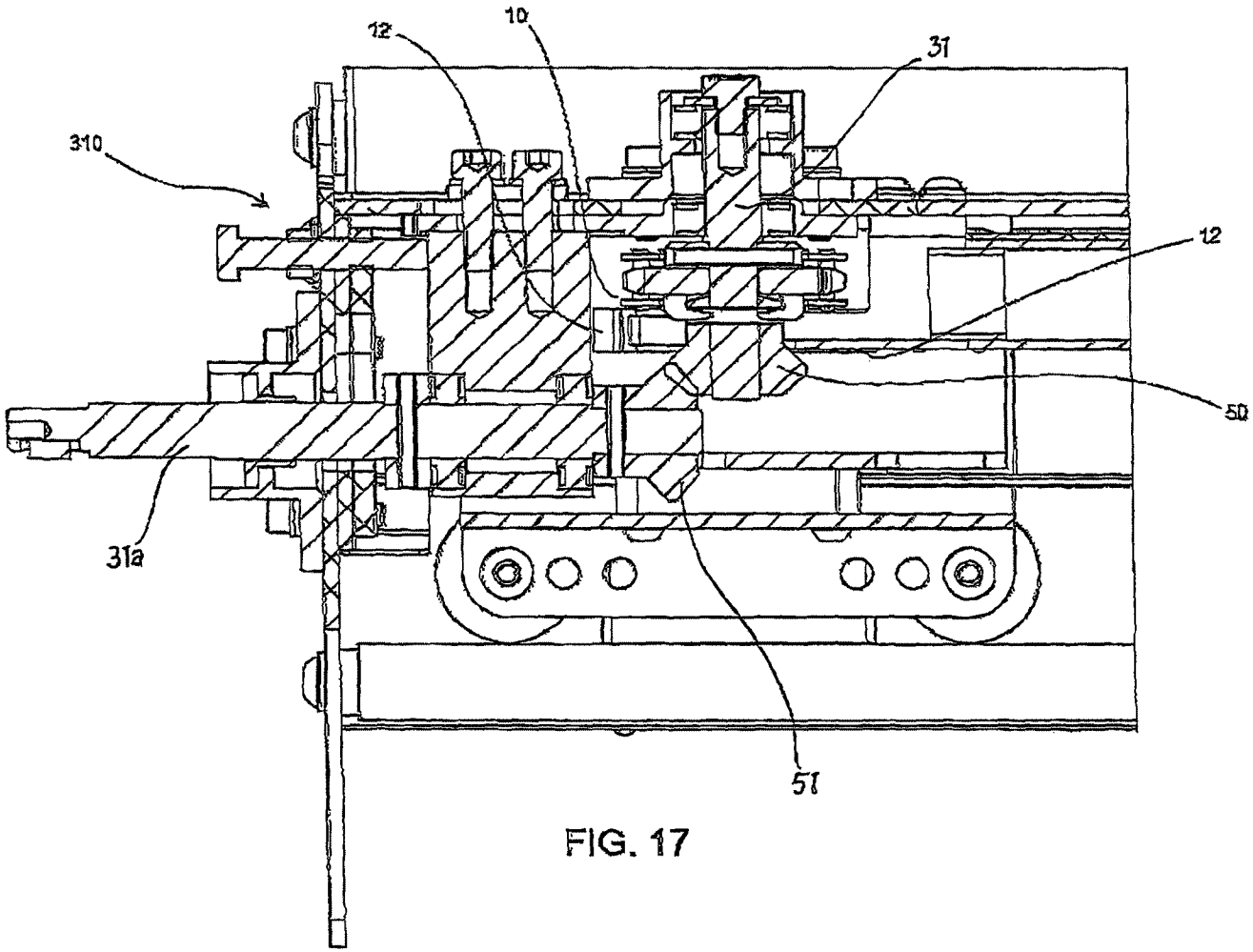
FIG. 17 is a plan view of a compact level winding mechanism according to another embodiment.

FIG. 17 shows another embodiment of a level winder 310 according to the invention, incorporating the compact level winder arrangement 10 in which the split carriage guide 12 is shown to narrowly provide a clear passage defined by the gaps 13 so that it can travel passed the gears 50 without interfering or coming into contact therewith.

Figure 18:
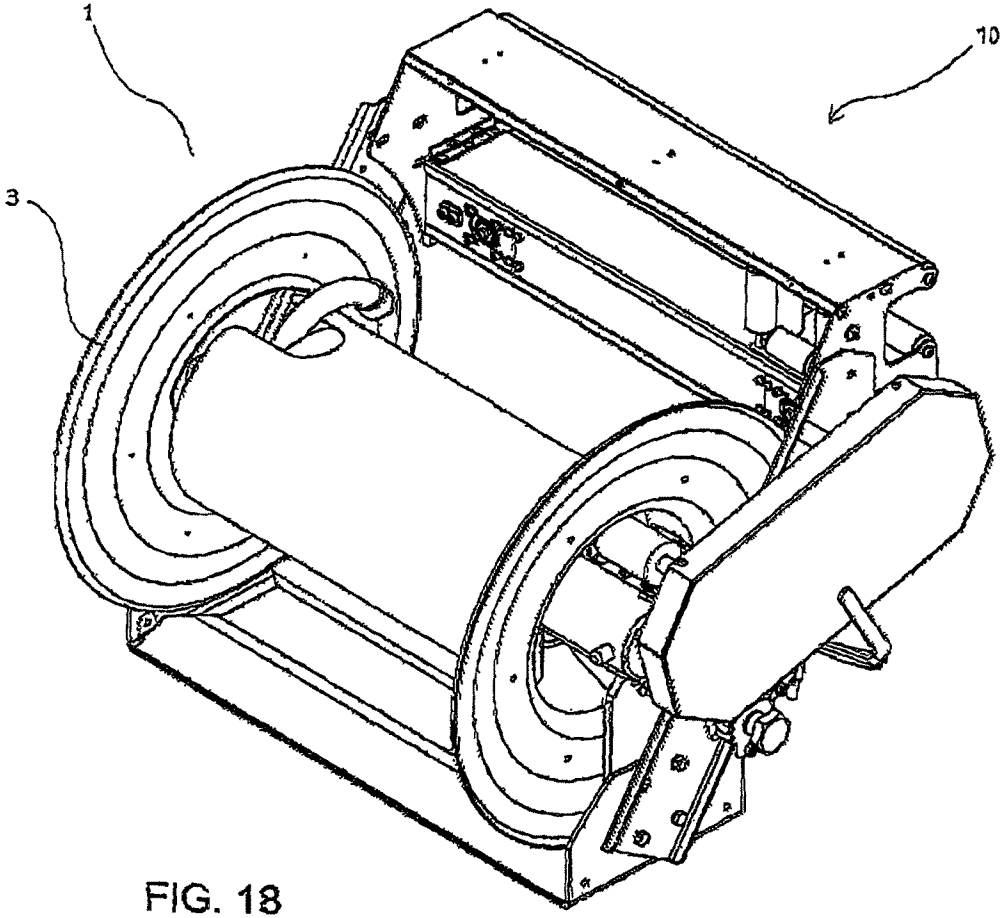
FIG. 18 is a perspective view of a complete hose reel assembly having installed a compact level winder arrangement.

FIG. 18 shows a complete hose reel 1, comprising a hose reel spool 3 fitted with a compact level winder 10.

Figure 19:
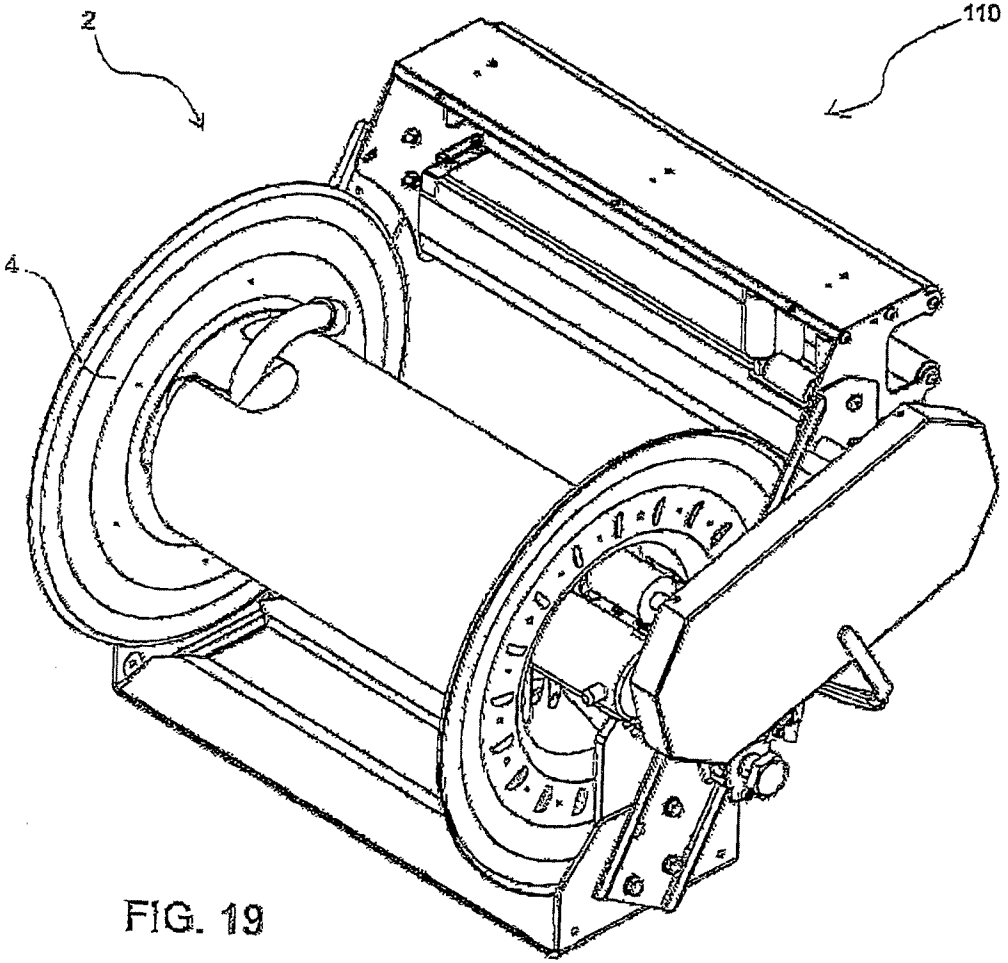
FIG. 19 is a perspective view of a complete hose reel assembly having installed a stacked dog level winder arrangement.

FIG. 19 shows a complete hosereel 2 fitted with a stacked level winder 110. Both winder arrangements 10, 110 are substantially similar in dimensions and therefore easily interchangeable on either of the hose reel spools 3, 4.

To better understand the invention, reference is made to the embodiments shown in FIGS. 9-12 and 13-15*b*. In the level winder 10 in FIG. 11, the sprocket drive shaft 31 is supported by a front mounted bearing assembly 53, comprising bearing housing 54 containing a set of bearings 55, 56 that support the sprocket shaft 31 in cantilevered fashion. It can be seen that the series of components is not as linearly compact extending from the front to the rear of the level winder assembly 10, the components being, in general order, the bearing housing 54, mounted to the beam 40, internally of the beam 40 being the sprocket 29 and bevel gears 50 which extend passed the chain dog 32 and carriage guides 12 and face to the rear. The rearwardly facing gears 50 mesh with the complementary primary drive gears of the primary shaft 31*a* to transfer the rotational force 90° from the primary drive shaft gears to the bevel gears 50. The other side of the carriage 20 has mounted thereon the bracket 60 that supports the hose guide 108, so that the hose guide 108 translates back and forth with the movement of the carriage 20. The axis of the primary shaft 31*a* intersects with the sprocket shaft 31 beyond or outside the length of the sprocket shaft 31.

The perspective and partially exploded view of this arrangement 130 in FIG. 15*b* demonstrates the mechanism by which the gears 50 translate the rotation about the primary axis 31*b* into rotation of the sprocket 29, the gears 50 meshing intermediate the length of the sprocket shaft 31 intermediate the length of the assembly 110, rather than at one end as in the extended arrangement 10 shown in FIG. 11

The stacked extension arrangement 130 as shown in FIG. 13 illustrates that the primary drive shaft axis 31*b* intersects with the sprocket shaft 31 intermediate the length of the sprocket shaft 31. Depending on the orientation of the primary shaft, the primary shaft 31*a* and the sprocket shaft 31*b* may or may not lie in the same horizontal plane and the primary shaft 31*a* may be offset from the sprocket shaft above or gbelow the sprocket shaft 31*a*. In the shown stacked arrangement 130, the bevel gears 50 are turned to face inwardly, so that the space along the length of the sprocket shaft 31 taken up by the primary gears 51 (see FIG. 15*b*) is overlapped with the space taken up by the shaft 31. Therefore space is saved through a horizontal direction from the front of the level winder 110 (nearest to horizontal rollers 104, 105) extending rearwardly, as the gears 150 are not an add on in series as in the first embodiment 10, but are compactly arranged within the side profile footprint of the sprocket shaft 31. The sprocket shaft 31 is particularly well-supported in this arrangement 130 by the spaced bearings 156 that support the shaft 31 either side of the meshing of the gears (51, 150), so that the shaft (31) is not cantilevered but strongly supported by bearings 156 at either end at either end and close to the driven sprocket 129 at the front-most end.

DETAILED DESCRIPTION CORRESPONDING TO PCT/AU2011/001152

Referring to Application No. PCT/AU2011/001152, FIG. 1*a* shows a drive mechanism 130 that is coupled to the level wind controller 100 shown in FIG. 2*a*. The drive mechanism comprises reducing gears including sprockets 7, 27 that are easily interchangeable, unlike the prior art, due to the mounting mechanism designed by the applicants in which a connector hub 8 for the transitioning sprocket 7 allows easy disassembly and replacement of one sprocket 7, 27 for another, so that the gear ratios of the device 100 can be modified to suit different applications, such as different sized (length) level winder assemblies made according to the invention, different sized hoses, and desired reel winding speeds.

In FIG. 1*b* there is shown a preferred form of the level winder assembly 300 which demonstrates the capacity of the device to be easily adjusted in length to suit a variety of hose reel size requirements and applications. Instead of providing a beam 103 in one piece, the linear guide 303 is made up of pair of identical end sections 305, 306 that provide guides or supports for the chain 29. The beam 303 is generally channel shaped and its top and bottom walls are adapted to trap the carriage wear plates 9 (see FIG. 3*b*) therein. In FIG. 3*a*, the beam 303 is more clearly seen. Extending from the internal vertical wall of the beam 303 are a pair of ribs 308,309 extending the length of the beam to support the chain 30. There are a pair of wear plates 9 above and below the carriage housing 5. The wear plates are made of PTFE (Teflon®) to ensure friction is kept to a minimum as the carriage 110 travels up and down the beam 303.

With reference to FIG. 3*a*, the carriage housing is able to be shifted towards or away from the beam 303 to move the latches 112 into and out of the plane of engagement of the chain dogs 32 by means of a telescopic cam tube 37. The cam tube 37 is rotatable about and telescopically mounted on a stub 37*b* extending normally from the outer wall plate 119*a*. A pin 38*a* is press fitted into the stub through radially opposed apertures to present a pair of radial knobs protruding from the surface of the stub 37*b*. The cam tube 37*b* has a corresponding S-shaped slot 37*c* to receive the pin knob 38*a* which combination controls the rotation of the cam tube 37 about the stub 37*b*. The arrangement is such that the compression springs 118*b*, held in compressed stated by the axial compressive combinations of a plurality of bolts 25 extending through a lift plate 47 and tube guides 61 (4 in this case corresponding to the number of deflector latches 112) to receive the spring 118*b* as a sleeve and the latch 112 as a nut (the latch 112 being also pivotally engaged by a short bolt 16 extending through the upper and lower plates 119). The cam tube 37 is axially connected to handle lever 140, 35 that can be used to rotate the cam tube 37, bearing against the plate 47 to move the carriage housing 5 and latches 112 into and out of the engagement plane of the chain dogs 32.

The level winder device 100 includes a pair of spaced and opposed side walls 101, 102 connected by an elongate beam 103 and supported for rotation about axes parallel to the longitudinal axis of the beam 103 a pair of upper and lower elongate rollers 104, 105 to control the height at which a hose (not shown) is wound on or paid out relative to the spool 201. Mounted for reciprocal linear travel along horizontal rails 103 is a carriage 110 comprising a roller housing 41 and a pair of spaced short rollers mounted for rotation about a respective vertical axes. The short vertical rollers 106, 107 are adapted to control the pay out and the winding on of the hose with regard to lateral placement on the spool 201 and are spaced sufficiently to permit the free passage of the hose defined by the gap between the vertical rollers 106, 107 and the horizontal rollers 104, 105. The hose reel 200 includes the spool 201 and reel disc 202.

The exploded view of the level winding assembly 100 is shown in FIG. 9*b* and reference is made to the reference tables in FIGS. 1, 2, 9*a* and 9*b* in this connection, which tables are incorporated herein by reference.

FIGS. 2 2*a*(i)-2*a*(iii) shows the carriage assembly 110 mounted on the level winding assembly 100 for linear reciprocal motion along a rail 103 extending between the ends of the carriage assembly 100. The level winding assembly 100 includes a drive means 120 including a drive shaft 231 operably engaged to the variable level wind speed gear or reduction mechanism 130 as show in FIG. 11. The level winder drive mechanism 120 includes bevelled gears 121 adapted to engage with vertically aligned and spaced sprockets 125, 126 that lie in the same plane and are adapted to drive a tensioned chain 30 comprising a loop that travels in a vertical plane corresponding to the plane of the spaced sprockets 29, 125, 126. The chain 30 preferably includes multiple, equispaced dogs 32, for example at 100 mm or greater intervals. The closeness of the dogs 32 with respect to adjacent dogs is determined by the application, noting that even a chain 30 with a single dog 32 would still be largely operable, although corrective winding might be required in particular cases where the winding has got in ineffective, irregular or inefficient.

The carriage 110 is adapted to reciprocate along a linear pathway by engagement with beam 103 support and guides for chains and tie in the beam 103 end pieces 127, 128 extending a substantial proportion of the length of the horizontal rollers 104, 105 and defining the lateral limits of travel of the carriage assembly 110. The carriage assembly includes a cam mechanism and lever assembly 140 adapted to shift the carriage 110 out of engagement with the chain 30 as described herein. The chain 30 comprises regularly spaced dogs or lobes adapted to engage a plurality of deflectable latch ramps housed in the lower section 111 of the carriage 110, the deflectable latch ramps 112 numbering 4 and located in apposed pairs 113, 114. The carriage comprises an upper section 115.

As show in FIGS. 3*a*-3*b*, the carriage may comprise more than a pair of spaced vertical rollers 106, 107, but may comprise a set of four or more vertical rollers to control the lateral positioning of the hose during payout and winding in of the hose.

In FIG. 6, there is shown two variants of the deflectable latch ramp 112*a*, 112*b*. The deflectable latch ramps comprise a flat face 116 adapted to engage a dog 32 mounted on the chain 30 and a ramped surface 117 adapted to permit the dog 32 to ride over the ramp 117 when the chain is travelling in a reverse direction. Various mechanisms can be provided to permit deflection of the latch ramp 112, the preferred arrangement being shown in FIGS. 6 and 6*b*, where the latch ramp 112 is pivotally mounted and sprung against deflection towards the wall 119*a*.

The opposed pairs of latch ramps 113, 114 lie in different vertical planes, as shown in FIG. 5. This permits the latch ramps to variously engage with the chain dogs 32 selectively, depending on the direction of travel of the chain 30.

As shown in FIG. 5*b*, the latch ramps 112 are pivotally mounted to horizontal and spaced walls 119 joined by a vertical plate 119*a*.

The crank 140 provides a cam mechanism whereby to vertically shift the carriage 110 away from the chain 30 and out of engagement and out of the plane of travel of the dogs 32, so that the carriage is free to stop. This may be achieved by an automated mechanism utilising a solenoid or mechanical device 145.

The offset alignment of the latch ramps 112, by their pairings 113, 114 allows the carriage device to slip passed the chain dogs 32 on payout when the hose is hauled by an operator, and to engage the chain dogs 32 during winding on of the hose. As the skilled person will appreciate, it is only important during rewind to control the winding of the hose onto the spool 201, but not in the payout mode of the hose reel 200. Complete delatchment of the carriage 110 from the chain dogs is achieved by shifting the carriage 110 by the manual cam lever 140 or solenoid 145 to shift the latch ramps 112 out of the plane of the chain dogs 32. Furthermore, the gear box generally shown in FIG. 1 with reference to reference numeral 130 and shown in greater detail in the sketch of FIG. 11, the gear box 130 may be disengaged for totally free payout of the hose reel 200.

Referring to FIG. 7, the drive mechanism 30 for the level winding assembly is shown in greater detail. As can be seen, the drive shaft 31 is operably connected to vertically oriented sprockets 29 which carry a tensioned chain 30. The chain 30 carries multiple dogs 32 that engage latch ramps 112 by abutting their broad face 116 whereby to move the carriage assembly 110 along the rails 103. The dog 32 is generally block shaped and dimensioned to match the general dimensions of the link to which it is attached on the drive chain 30. The dog 32 is about the same length, height and depth of a link, with a similar radius 138 at each of its respective ends 133. The radiused ends 138 facilitate smooth transfer over the ramped surfaces 117 of the latches 112, whilst presenting a solid engagement surface when abutting the flat faces 116 of the latches 112.

Preferably, as shown in FIG. 5*b*, the latch ramps 112*b* are four in number, with a latch ramp 112 located in each corner of the lower section of the carriage assembly 110 to reduce lag times and facilitate clean and responsive engagement of the carriage assembly 110 with the drive assembly 30.

In relation to FIG. 8 there is shown a breaking device 230 comprising a main bracket 231 adapted to be mounted to a hose reel 200 and a brake in the form of a rubber roller 235 adapted to engage a reel disc 202 (see FIG. 2*b*). The roller 235 is rotatably mounted to a U-shaped axle support 236 which, in turn, is axially mounted to a shaft 237 journalled in the bracket 231 and braced between bushes 238 and a brake bracket 239. The brake bracket 239 is spaced from the main bracket 231 whereby the roller 235 is mounted to apply axial force through the shaft 237 to the reel disc 202, whereby the roller 235 is adapted to permanently engage and abut the reel disc 202. The axial tension of the roller (an axial force applied to the reel disc 202 surface) is applied through the shaft 237 to the reel disc 202 and is controlled by rotation of the shaft 237, threadably engaged to the main plate 231.

The tension imposed by the roller 235 is adjustable by axially displacing the threaded shaft 237. In this regard, the shaft 247 is rotatable by a handle 243 whereby to vary the length of shaft 237 extending beyond the main plate 231 towards the disc reel 202 and the consequent force applied thereto, the force being regulated by the compression spring 240 interposed between the brackets 231, 239.

The orientation of the roller 235 axis 246 is controlled by the attachment of the axle bracket 236 to a tube shaft 238 that is integrally formed with its slotted extension sleeve 242 on the opposite side of the main bracket 231. The slotted sleeve surrounds the shaft 237 and spring 240 an the slotted sleeve extends integrally into a brake lever 244. The brake lever 244 may assume any one of a number of radial positions about the brake bracket 239, being sprung to bear on the outer edge of the brake bracket 239. The lever 244 is flat faced and cooperates with one of a number of positions around the brake bracket 239 to vary the roller axis orientation in one of a number of fixed axial alignments. The alignment of the roller axis 246 may be varied by moving the sprung lever 244 whereby to either allow the roller to freely rotate relative to the reel disc 202 or be rotated diagonally to apply considerable friction to the reel disc 202 through to the point of engagement with the roller 235, such that the roller 235 may be oriented so as to cease rolling and provide a locking brake to the reel disc 202.

In an alternative arrangement shown in FIG. 8, the lever 244 is replaced with a rod 244*a* having a round cross-section and the brake bracket 239 is replaced with a scalloped or sprocket like bracket 239*a* having a large number of radial positions into which the sprung lever 29*a* nests. The range of angles of the roller axis 246 relative to the direction of travel of the reel disc 202 at the point of engagement is consequently much greater in this arrangement. Accordingly, the payout or winding procedures may be regulated by the brake means 230.

DEFINITIONS AND EXPLANATIONS

In the present specification, terms such as "apparatus", "means", "device" and "member" may refer to singular or plural items and are terms intended to refer to a set of properties, functions or characteristics performed by one or more items or components having one or more parts. It is envisaged that where an "apparatus", "means", "device" or "member" or similar term is described as being a unitary object, then a functionally equivalent object having multiple components is to considered to fall within the scope of the term, and similarly, where an "apparatus", "assembly", "means", "device" or "member" is described as having multiple components, a functionally equivalent but unitary object is also considered to fall within the scope of the term, unless the contrary is expressly stated or the context requires otherwise.

Throughout the specification and claims the word "comprise" and its derivatives are intended to have an inclusive rather than exclusive meaning unless the contrary is expressly stated or the context requires otherwise. That is, the word "comprise" and its derivatives will be taken to indicate the inclusion of not only the listed components, steps or features that it directly references, but also other components, steps or features not specifically listed, unless the contrary is expressly stated or the context requires otherwise.

Whilst the invention is generally be described with reference to storage spools or reels for both hose and cable for the sake of convenience, the word "hose" is used herein to mean both "hose" and "cable". The term "wear part" refers to a component characteristically subject to wear and required to be replaced as part of routine maintenance of the device of which it forms a part. Where the term "chain" or "drive chain" or "chain dog" or like terms including the word "chain" are used, the skilled reader will appreciate that functional equivalent drive transfer devices such as a "belt" may be used and it is envisaged that the terms "chain" and "belt" are interchangeable, unless expressly stated or the the context indicates otherwise.

Orientational terms used in the specification and claims such as vertical, horizontal, top, bottom, upper and lower are to be interpreted as relational and are based on the premise that the component, item, article, apparatus, device or instrument will usually be considered in a particular orientation, typically with the roller 104 uppermost. However, when referring to the carriage guide 112 herein, "uppermost" corresponds to the upper surface 115.

Therefore while we have described herein one particular embodiment of the invention it is to be understood that variations and modifications in the materials used and the features described can still lie within the scope of the invention.

As the invention relates to level winders for both hose and cable reels, reference to the word "hose" in the specification and the claims which follow this description should also be taken to be a reference to the word "cable". In the specification and claims, a reference to the term drive "chain dog" is to be taken to also refer to the term: a drive "belt dog", unless expressly stated or the context clearly indicates otherwise.

Table of Reference Numerals

| No. | Description | No. | Description |
|---|---|---|---|
| 1, 2 | Hose reel | 42 | Rails |
| 3, 4 | Hose reel spools | 50, 150, 250 | Bevelled gears |
| 5 | Space shared by gears and circular recess | 51 | Primary gears |
| | | 52 | Tooth gear underside |
| 6 | Primary drive | 53 | Front bearing assembly |
| 10, 110, 210, 310 | Level winding (mechanism) | 54 | Bearing housing |
| | | 55, 56 | Sprocket shaft bearings |

-continued

Table of Reference Numerals

| No. | Description | No. | Description |
|---|---|---|---|
| 11a | First upper carriage guide | 60 | Doughnutsupporting bracket |
| 11b | Second lower carriage guide | 64, 66 | Side panels |
| | | 68 | Apertures |
| 12 | Carriage guides | 104 | Horizontal roller |
| 13 | Gaps | 105 | Front horizontal roller |
| 14, 114 | Chain guide internal concave wall | 106, 107 | Vertical rollers |
| | | 108 | Doughnut shaped hose guide |
| 16, 116 | Chain dog outer convex wall | 112 | Doughnut shaped (circular recessed) carriage guide |
| 17 | Circular region | | |
| 18a | Curve centre of the upper carriage guide | 113 | Inner circular recess |
| 18b | Curve centre of the lower carriage guide | 115 | Upper surface of carriage guide |
| | | 117 | Internal curved surface defining recess 113 |
| 19 | Ends of carriage guides | | |
| 20, 120, 220 | Carriage (assembly or housing) | 130 | Stacked extension arrangement |
| | | 131 | Chain link mounting member |
| 27 | Inner recess of dog | 131a | Drive mechanism |
| 28 | Inner edge of dog | 132 | Dog extension |
| | | 134 | Chain dog spacer or bush dog |
| 29, 129, 129a-c | Sprockets | 135 | Outer lip of dog extension |
| 30 | Drive mechanism in form of tensioned chain (not shown in FIG. 1) | 136 | Dog extension disc |
| 30a | Chain link bearing dog | 155, 156 | Rear and front sprocket shaft bearings |
| 31, 231 | Sprocket drive shaft | | |
| 31a, 31b | Primary drive shaft and axis | 157, 158 | Bearing support plates |
| 32 | Chain dog | | |
| 33 | Center of curve of outer wall of chain dog | 236 | Bearings |
| | | 260 | Rear mounting bracket |
| 34 | Tapered radiused ends of chain dog | 262 | Back plate |
| 35 | Pins | 270 | Hose guiding rear rollers |
| 36 | Circlip | | |
| 40, 140, 240 | Beam | | |

ANNEXURE A

Level Wind Design Dwell Time Consideration Definition

V=Linear Velocity (mm/s)

ω=Angular Velocity (Rotation Speed) (rad/s)

Θ=Angular Distance (radian)

r=Radius (mm)

t=Dwell Time (s)

Engineering Principle and Design Formulas

Figure 20:
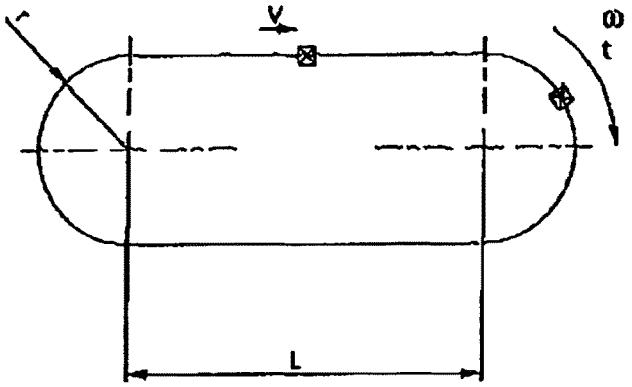
FIG. 20 is a schematic diagram of the level wind carriage motion.

A schematic of the Level Wind Carriage motion can be defined as in the Diagram 1 shown in FIG. 20.

As the change does not change, the pitch on the sprockets will remain the same. To calculate the Dwell time at each end the following formula can be derived:

$$\omega = \text{rad}/s$$

$$\omega = \Theta/t$$

$$t = \Theta/\omega \qquad \text{(Equation 1)}$$

From Equation 1, it can be seen that the Dwell Time (t) is inversely proportional to the Angular Velocity (ω). As the Θ does not change from design to design, it can be shown from Equation 1 that the only other value that will change the Dwell Time is the Angular velocity. Hence, if the angular velocity does not change, the dwell time will not change.

The other variable that must be considered in a Level Wind is the Linear Velocity which is defined by the following equation:

$$V=\omega\times r \quad \text{(Equation 2)}$$

From Equation 2, it can be shown that if you keep the Angular Velocity the Linear Velocity changes inversely proportional to the radius. This can be shown in the two examples where $r_1=2$ and $r_2=0.5$ as follows.

For example, if $r_1=2$, then $V_1=2.0\times\omega$). If $r_2=0.5$, then $V_1=0.5\times\omega$.

Level Wind Practical Application

When designing the correct specification for a Level Winder device, the designed should take into account hose reel width (corresponding to the length of the path of travel of the carriage) and the hose diameter.

From both Equations 1 and 2, the hose reel width is not a variable to consider. However, the hose diameter will define the Linear Velocity of the carriage and also the amount of Dwell Time that the carriage can have at either end.

To provide a desirable wrap using a level winding device, the Linear Velocity should be defined first, so this value should be made constant. As an example, if the Linear Velocity should be 15 mm/sec and the driving sprocket diameter is 33.2 mm, then:

$$V=\omega\times r\rightarrow\omega p=V/r\rightarrow\omega-0.015/(33.3/2)\rightarrow\omega-7.5 \text{ rad } s^{-1}$$

From Equation 1 where the angular movement is 180°, the Dwell Time can be calculated:

$$t=\Theta/\omega\rightarrow t=180/7.5\rightarrow t=3.477 \text{ secs}$$

If the driving sprocket diameter is increased to 61 mm and the Linear Velocity is maintained, the Dwell Time can be calculated as follows:

$$\omega=V/r\rightarrow\omega=0.015/(61.0/2)\rightarrow\omega=0.492 \text{ rad } s^{-1}$$

$$t=\Theta/\omega\rightarrow t=180/0.492\rightarrow t=6.3879 \text{ secs}$$

Therefore the Dwell Time has increased. Decreasing the sprocket diameter, while maintaining the same Linear Velocity will cause the Dwell Time to decrease.

The invention claimed is:

1. A level winder for use on a hose reel, the level winder comprising:

a carriage operatively connected to a hose guide, the carriage adapted to control the winding of the hose onto the hose reel and to allow the hose to be paid out through the hose guide;

a drive mechanism operating in a drive mechanism plane and carrying at least one drive dog, the drive dog being in a shape of a crescent or in a shape of a cylindrical external wall capped by an outer lip, mounted on a chain or belt that is driven by a pair of spaced sprockets or drive wheels that are in turn rotatably mounted on a sprocket or drive wheel shaft, and adapted to engage a carriage guide on which the carriage is mounted to move the carriage reciprocally along a track, wherein the carriage guide is aligned in a same plane that the drive dog travels; and the carriage guide comprising at least one curved surface adapted to define a recess and to engage a curved surface of the drive dog, such that at least a portion of the drive dog curved surface is always facing or engaged with the carriage guide curved surface and remains trapped in the recess.

2. The level winder according to claim 1 wherein the carriage guide includes a pair of opposed generally crescent shaped members.

3. The level winder according to claim 2 wherein a gap between the carriage guide members is less than an extent of the drive dog curved surface.

4. The level winder according to claim 1 wherein the drive dog curved surface is radiused to correspond generally to a radius of the carriage guide curved surface.

5. The level winder according to claim 1 wherein the sprocket or drive wheel shaft is driven by a primary drive shaft that engages the sprocket or drive wheel shaft through gears.

6. A hose reel including a level winder, the level winder comprising:

a carriage operatively connected to a hose guide, the carriage adapted to control the winding of the hose onto the hose reel and to allow the hose to be paid out through the hose guide;

a drive mechanism operating in a drive mechanism plane and carrying at least one drive dog, the drive dog being in a shape of a crescent, mounted on a chain or belt that is driven by a pair of spaced sprockets or drive wheels that are in turn rotatably mounted on a sprocket or drive wheel shaft, and adapted to engage a carriage guide on which the carriage is mounted to move the carriage reciprocally along a track, wherein the carriage guide is aligned in the same plane that the drive dog travels; and the carriage guide comprising at least one curved surface adapted to define a recess and to engage a curved surface of the drive dog, such that at least a portion of the drive dog curved surface is always facing or engaged with the carriage guide curved surface and remains trapped in the recess.

7. A level winder for use on a hose reel, the level winder comprising:

a carriage operatively connected to a hose guide, the carriage adapted to control the winding of the hose onto the hose reel and to allow the hose to be paid out through the hose guide;

a drive mechanism operating in a drive mechanism plane and carrying at least one drive dog that is adapted to engage a carriage guide on which the carriage is mounted to move the carriage reciprocally along a track, wherein the carriage guide is aligned in a same plane that the drive dog travels; and the carriage guide includes at least one curved surface forming a recess and engaging a curved surface of the drive dog, such that at least a portion of the drive dog curved surface is always facing or engaged with the carriage guide curved surface and remains trapped in the recess, and wherein the carriage guide is a single block forming the recess as a circular recess having the at least one curved surface.

8. The level winder according to claim 7 wherein the drive dog includes an outer peripheral flange or lip that engages a top surface of the carriage guide.

9. The level winder according to claim 7 wherein the drive dog is spaced from a drive chain or belt by an intermediate spacing member.

10. The level winder according to claim 7 wherein the drive dog is in a shape of a disc.

11. The level winder according to claim 7 wherein the drive dog is mounted on a chain or belt that is driven by a pair of spaced sprockets or drive wheels that are in turn rotatably mounted on a sprocket or drive wheel shaft, wherein the sprocket or drive wheel shaft is driven by a primary drive shaft that engages the sprocket or drive wheel shaft through gears, and wherein the gears include a bevel gear that is mounted to the sprocket shaft in coaxial relationship and a non-engaging rear faces of teeth of the gear are angled to provide clearance for the passage of the drive dog as it travels around each sprocket.

* * * * *